US008458969B2

(12) United States Patent
Richardson et al.

(10) Patent No.: US 8,458,969 B2
(45) Date of Patent: Jun. 11, 2013

(54) STAY-IN-PLACE FORM SYSTEMS FOR FORM-WORK EDGES, WINDOWS AND OTHER BUILDING OPENINGS

(75) Inventors: George David Richardson, Vancouver (CA); Semion Krivulin, Richmond (CA); Jaret Breckenridge, Vancouver (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 90 days.

(21) Appl. No.: 12/841,138

(22) Filed: Jul. 21, 2010

(65) Prior Publication Data

US 2010/0325984 A1 Dec. 30, 2010

Related U.S. Application Data

(63) Continuation-in-part of application No. PCT/CA2009/000052, filed on Jan. 21, 2009.

(60) Provisional application No. 61/022,503, filed on Jan. 21, 2008.

(51) Int. Cl.
*E04G 15/02* (2006.01)
*E06B 1/04* (2006.01)

(52) U.S. Cl.
USPC ..... 52/215; 52/217; 52/656.2; 52/656.4; 52/745.17; 249/13; 249/19; 249/39

(58) Field of Classification Search
USPC ..... 52/215, 656.2, 656.5, 362, 375, 656.4, 52/575, 210–213; 249/39, 35, 134, 142, 150, 249/13, 19, 177
See application file for complete search history.

(56) References Cited

U.S. PATENT DOCUMENTS

| | | | |
|---|---|---|---|
| 154,179 | A | 8/1874 | Hubert |
| 374,826 | A | 12/1887 | Clarke |
| 510,720 | A | 12/1893 | Stewart, Jr. |

(Continued)

FOREIGN PATENT DOCUMENTS

| | | |
|---|---|---|
| CA | 0574720 | 4/1959 |
| CA | 0957816 | 11/1974 |

(Continued)

OTHER PUBLICATIONS

Vector Corrosion Technologies Marketing Materials, 2005.

(Continued)

*Primary Examiner* — Jeanette E. Chapman
(74) *Attorney, Agent, or Firm* — Oyen Wiggs Green & Mutala LLP

(57) ABSTRACT

A stay-in-place buck for defining an opening in a cast concrete structure has a plurality of frame members arrangeable in an abutting relationship. Each of the frame members has a panel extending transversely between outer opposed panels of a stay-in-place form-work. Flanges extend from opposed edges of the frame member panel for abutment against outer surfaces of the outer opposed panels. Each flange has opposed mitered end edges for abutment against adjacent mitered end edges of flanges of adjacent frame members. The buck also includes fastener-receivers connectable to the panels of the frame members to form one or more fastener-receiving frames extending at least partially about a perimeter of the buck. Each fastener-receiver has mitered edge portions for abutment against adjacent mitered edge portions of adjacent fastener-receivers.

33 Claims, 26 Drawing Sheets

U.S. PATENT DOCUMENTS 820,246 A 5/1906 Nidds
1,035,206 A 8/1912 Lewen
1,080,221 A 12/1913 Jester
1,244,608 A 10/1917 Hicks
1,276,147 A 8/1918 White
1,345,156 A 6/1920 Flynn
1,423,879 A 7/1922 Potter
1,637,410 A 8/1927 Corybell
1,653,197 A 12/1927 Barnes
1,715,466 A 6/1929 Miller
1,820,897 A 8/1931 White et al.
1,875,242 A 8/1932 Hathaway
1,915,611 A 6/1933 Miller
1,963,153 A 6/1934 Schmieder
2,008,162 A 7/1935 Waddell
2,050,258 A 8/1936 Bemis
2,076,472 A 4/1937 London
2,164,681 A 7/1939 Fould
2,172,052 A 9/1939 Robbins
2,326,361 A 8/1943 Jacobsen
2,861,277 A 11/1958 Hermann
2,892,340 A 6/1959 Fort
2,928,115 A 3/1960 Hill
3,063,122 A 11/1962 Katz
3,100,677 A 8/1963 Frank et al.
3,152,354 A 10/1964 Diack
3,196,990 A 7/1965 Handley
3,220,151 A 11/1965 Goldman
3,288,427 A 11/1966 Pluckebaum
3,291,437 A 12/1966 Bowden et al.
3,468,088 A 9/1969 Miller
3,545,152 A 12/1970 Knohl
3,555,751 A 1/1971 Thorgusen
3,588,027 A 6/1971 Bowden
3,769,769 A * 11/1973 Kohl ..... 52/212
3,788,020 A 1/1974 Gregori
3,886,705 A 6/1975 Cornland
3,951,294 A 4/1976 Wilson
3,991,636 A 11/1976 Devillers
4,023,374 A 5/1977 Colbert et al.
4,060,945 A 12/1977 Wilson
4,104,837 A 8/1978 Naito
4,106,233 A 8/1978 Horowitz
4,180,956 A 1/1980 Gross
4,276,730 A 7/1981 Lewis
4,351,870 A 9/1982 English
4,383,674 A 5/1983 Fricker
4,430,831 A * 2/1984 Kemp ..... 52/204.53
4,433,522 A 2/1984 Yerushalmi
4,434,597 A 3/1984 Fischer
4,508,310 A 4/1985 Schultz
4,532,745 A 8/1985 Kinard
4,543,764 A 10/1985 Kozikowski
4,550,539 A 11/1985 Foster
4,553,875 A 11/1985 Casey
4,575,985 A 3/1986 Eckenrodt
4,581,864 A 4/1986 Shvakhman et al.
4,606,167 A 8/1986 Thorne
4,695,033 A 9/1987 Imaeda et al.
4,703,602 A 11/1987 Pardo
4,731,964 A 3/1988 Phillips
4,731,971 A 3/1988 Terkl
4,742,665 A 5/1988 Baierl
4,856,754 A 8/1989 Yokota et al.
4,866,891 A 9/1989 Young
4,946,056 A 8/1990 Stannard
4,995,191 A 2/1991 Davis
5,014,480 A 5/1991 Guarriello et al.
5,124,102 A 6/1992 Serafini
5,216,863 A 6/1993 Nessa et al.
5,243,805 A 9/1993 Fricker
5,265,750 A 11/1993 Whiteley
5,311,718 A 5/1994 Trousilek
5,465,545 A 11/1995 Trousilek
5,489,468 A 2/1996 Davidson
5,491,947 A 2/1996 Kim
5,513,474 A 5/1996 Scharkowski
5,516,863 A 5/1996 Abusleme et al.
5,553,430 A 9/1996 Majnaric et al.
5,591,265 A 1/1997 Tusch
5,608,999 A 3/1997 McNamara
5,625,989 A 5/1997 Brubaker et al.
5,729,944 A 3/1998 De Zen
5,740,648 A * 4/1998 Piccone ..... 52/426
5,747,134 A 5/1998 Mohammed et al.
5,791,103 A * 8/1998 Coolman et al. ..... 52/215
5,824,347 A 10/1998 Serafini
5,860,262 A 1/1999 Johnson
5,953,880 A 9/1999 De Zen
5,987,830 A 11/1999 Worley
5,996,293 A 12/1999 Anderson et al.
6,070,375 A 6/2000 Anderson et al.
6,161,989 A 12/2000 Kotani et al.
6,167,669 B1 1/2001 Lanc
6,167,672 B1 1/2001 Okitomo
6,185,884 B1 * 2/2001 Myers et al. ..... 52/215
6,189,269 B1 2/2001 De Zen
6,212,845 B1 4/2001 De Zen
6,219,984 B1 4/2001 Piccone
6,220,779 B1 4/2001 Warner et al.
6,247,280 B1 6/2001 Grinshpun et al.
6,387,309 B1 5/2002 Kojima
6,435,470 B1 8/2002 Lahham et al.
6,435,471 B1 8/2002 Piccone
6,530,185 B1 3/2003 Scott et al.
6,550,194 B2 * 4/2003 Jackson et al. ..... 52/215
6,622,452 B2 9/2003 Alvaro
6,694,692 B2 2/2004 Piccone
6,698,710 B1 * 3/2004 VanderWerf ..... 249/216
6,832,456 B1 12/2004 Bilowol
6,866,445 B2 3/2005 Semler
6,935,081 B2 8/2005 Dunn et al.
7,444,788 B2 11/2008 Morin et al.
7,587,868 B2 * 9/2009 Hughes ..... 52/215
2003/0005659 A1 * 1/2003 Moore, Jr. ..... 52/473
2003/0155683 A1 8/2003 Pietrobon
2004/0010994 A1 1/2004 Piccone
2004/0093817 A1 5/2004 Pujol Barcons
2005/0016083 A1 1/2005 Morin et al.
2005/0016103 A1 * 1/2005 Piccone ..... 52/481.1
2006/0213140 A1 9/2006 Morin et al.
2009/0229214 A1 9/2009 Nelson
2010/0047608 A1 2/2010 Seccombe
2010/0050552 A1 3/2010 David et al.
2010/0071304 A1 3/2010 Richardson et al.

FOREIGN PATENT DOCUMENTS

CA 1316366 4/1993
CA 2097226 11/1994
CA 2141463 8/1996
CA 2070079 6/1997
CA 2170681 8/1997
CA 2218600 6/1998
CA 2215939 8/1999
CA 2226497 10/1999
CA 2243905 1/2000
CA 2255256 1/2000
CA 2244537 2/2000
CA 2255256 11/2002
CA 2418885 8/2003
CA 2502343 5/2004
CA 2502392 5/2004
CA 2499450 9/2005
CA 2577217 1/2006
CA 2629202 4/2008
CA 2681963 10/2008
CH 317758 1/1957
DE 1684357 4/1967
DE 1812590 6/1970
DE 2062723 8/1972
DE 3003446 8/1981
DE 3234489 3/1984
DE 3727956 5/1988
DE 29803155 6/1998
EP 0025420 3/1981
EP 0055504 7/1982
EP 0141782 5/1985

| | | |
|---|---|---|
| EP | 0757137 | 2/1997 |
| FR | 0507787 | 7/1920 |
| FR | 1381945 | 11/1964 |
| FR | 1603005 | 4/1971 |
| FR | 2535417 | 5/1984 |
| FR | 2721054 | 6/1994 |
| FR | 2717848 | 9/1995 |
| GB | 779916 | 7/1957 |
| GB | 2205624 | 12/1988 |
| JP | 05133028 | 5/1993 |
| JP | 09041612 | 2/1997 |
| JP | 2008223335 | 9/2008 |
| SE | 206538 | 8/1966 |
| WO | 8204088 | 11/1982 |
| WO | 9500724 | 1/1995 |
| WO | 9607799 | 3/1996 |
| WO | 9635845 | 11/1996 |
| WO | 9743496 | 11/1997 |
| WO | 0163066 | 8/2001 |
| WO | 0173240 | 10/2001 |
| WO | 03006760 | 1/2003 |
| WO | 2004088064 | 10/2004 |
| WO | 2008119178 | 10/2008 |
| WO | 2009059410 | 5/2009 |
| WO | 2010078645 | 7/2010 |

OTHER PUBLICATIONS

Vector Corrosion Technologies Marketing Materials, 2007.
Vector Corrosion Technologies Marketing Materials, 2008.
The Digigraph System, http://www.digigraph-housing.com/web/system.ht, accessed online Jan. 2012.
VBUCK, Vinyl Technologies Inc., http://www.vbuck.com/dynamic/files/52/assembly%20&%20installation__ManualInstructions1.0.pdf, Feb. 17, 2006.
Digigraph Brochure, Building Systems using PVC extrusions and concrete, accessed online Jan. 2012.
Digigraph Guide, Digigraph Systems Inc., Installation Guide for the Digigraph Construction System Composed of PVC Extrusions and Concrete, accessed online Jan. 2012.

* cited by examiner

STAY-IN-PLACE FORM SYSTEMS FOR FORM-WORK EDGES, WINDOWS AND OTHER BUILDING OPENINGS

REFERENCE TO RELATED APPLICATION

This application is a continuation in part of Patent Cooperation Treaty application No. PCT/CA2009/000052 filed 21 Jan. 2009 and entitled STAY-IN-PLACE FORM SYSTEMS FOR WINDOWS AND OTHER BUILDING OPENINGS which is hereby incorporated by reference herein and which in turn claims priority from U.S. patent application No. 61/022,503 filed 21 Jan. 2008 and entitled STAY-IN-PLACE FORM SYSTEMS FOR WINDOWS AND OTHER BUILDING OPENINGS which is hereby incorporated by reference herein.

TECHNICAL FIELD

The invention disclosed herein relates to stay-in-place forms for fabricating structures out of concrete or other similarly curable construction materials. Particular embodiments of the invention provide stay-in-place form systems for edges of structures including openings in building structures which may permit the installation of windows, doors, vents or other building components.

BACKGROUND

A window buck may be positioned in a building form-work (also referred to as a form) and secured to the form to block out (i.e. define) an opening in the form for the installation of windows, doors, or the like. Liquid concrete is subsequently placed in the form and around the buck. The concrete cures to form a building structure (e.g. wall, floor, ceiling, etc.) having an opening defined by the buck.

Some bucks are designed to be reusable and are removed from the building structure after the concrete has cured, leaving behind a concrete surface for mounting a window, door or other building component to be placed in the opening. Other stay-in-place bucks are designed to be left in the concrete after the concrete cures and may provide a frame for mounting the window or door, for example. Conventional bucks are typically made of wood or metal.

There are problems with using conventional stay-in-place window bucks, made of wood or metal, in modular stay-in-place forms. For example, stay-in-place wood bucks may be subject to warping, shrinkage or other problems which may be caused by temperature and/or humidity conditions. Stay-in-place wood bucks are also prone to infestation by insects or other pests. Stay-in-place metal bucks may be subject to corrosion and warping, due to expansion and contraction caused by varying temperature conditions.

In more recent years, some building structures have been fabricated from concrete using modular stay-in-place forms typically made of plastic. Examples of such modular stay-in-place forms include those described in US patent publication No. 2005/0016103 (Piccone) and PCT publication No. WO96/07799 (Sterling). The forms typically include a plurality of wall panels joined edge to edge to form wall segments, and a plurality of support panels which extend between and connect to the wall segments at transversely spaced apart locations. Liquid concrete is placed in the form between the wall segments and fills the interior portion of the form. When the concrete cures, the concrete (together with the form) provide a structural component (e.g. wall, floor, ceiling, etc.) for a building.

U.S. Pat. No. 6,530,185 (Scott et al.) discloses a plastic window buck for use with insulated concrete form walls. The Scott et al. window buck has various limitations.

There is a general desire to provide modular stay-in-place form systems for forming building openings which may receive windows, doors, vents or other building components.

As discussed above, modular stay-in-place forms made of plastic have been used to fabricate building structures. Such modular stay-in-place forms could be used to fabricate other structures, such as (by way of non-limiting example): tank walls, piping structures, water management structures (e.g. dams, spillways and/or the like) and transportation structures (e.g. bridge supports, highway dividers, subway tunnels and/or the like). Structures fabricated using such modular stay-in-place forms may have edges. There is a general desire to provide form edge systems for such modular stay-in-place form systems which form edges and may be used to form corners, extremities or other edges of building structures or other structures. Building openings and structural openings represent one example of an edge of a structure.

BRIEF DESCRIPTION OF THE DRAWINGS

In drawings which depict non-limiting embodiments of the invention.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive sense.

Figure 1:
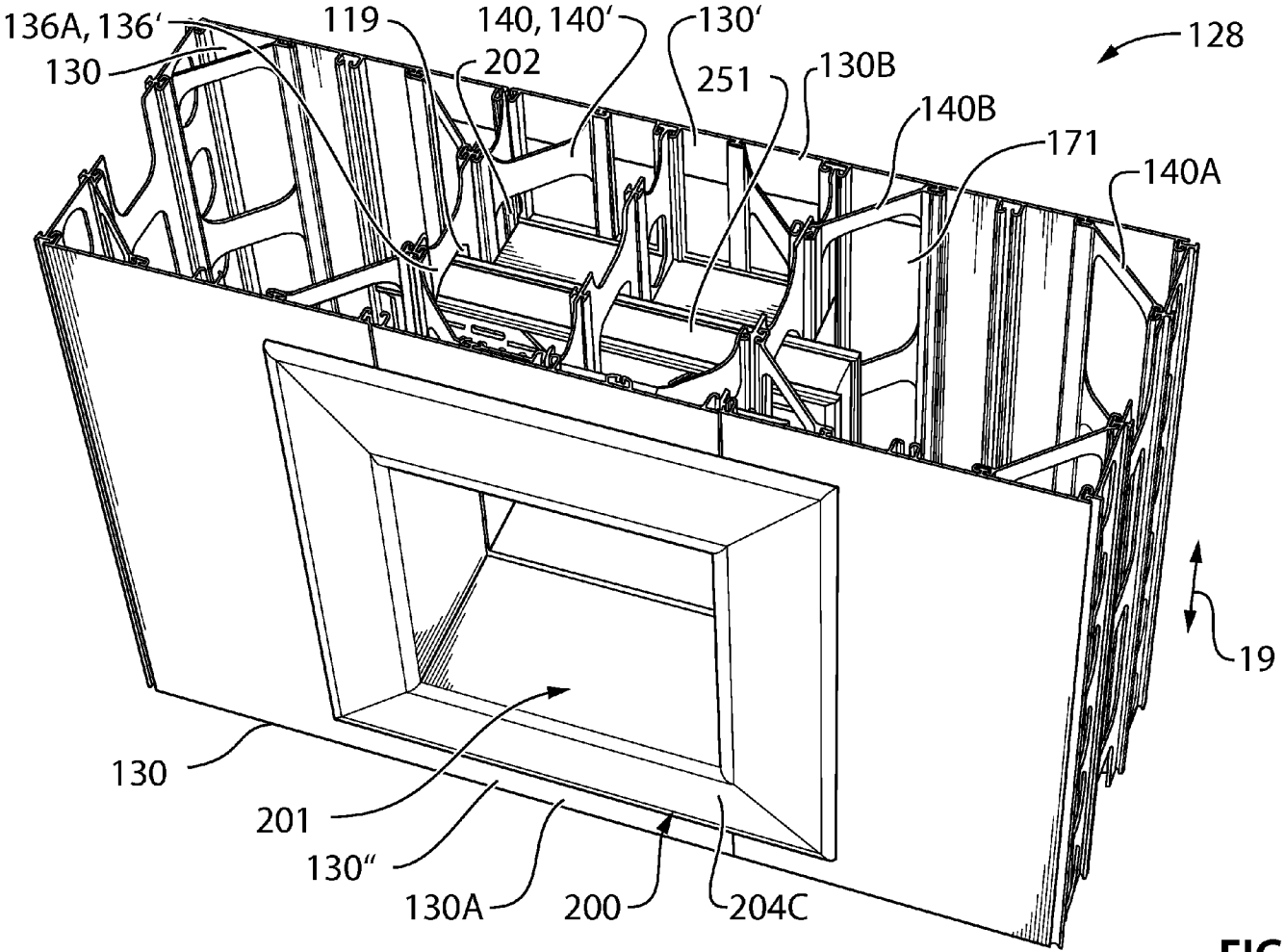
FIG. 1 is a perspective view of a buck according to one embodiment of the invention mounted in a cell of a modular stay-in-place form.
Figure 2:
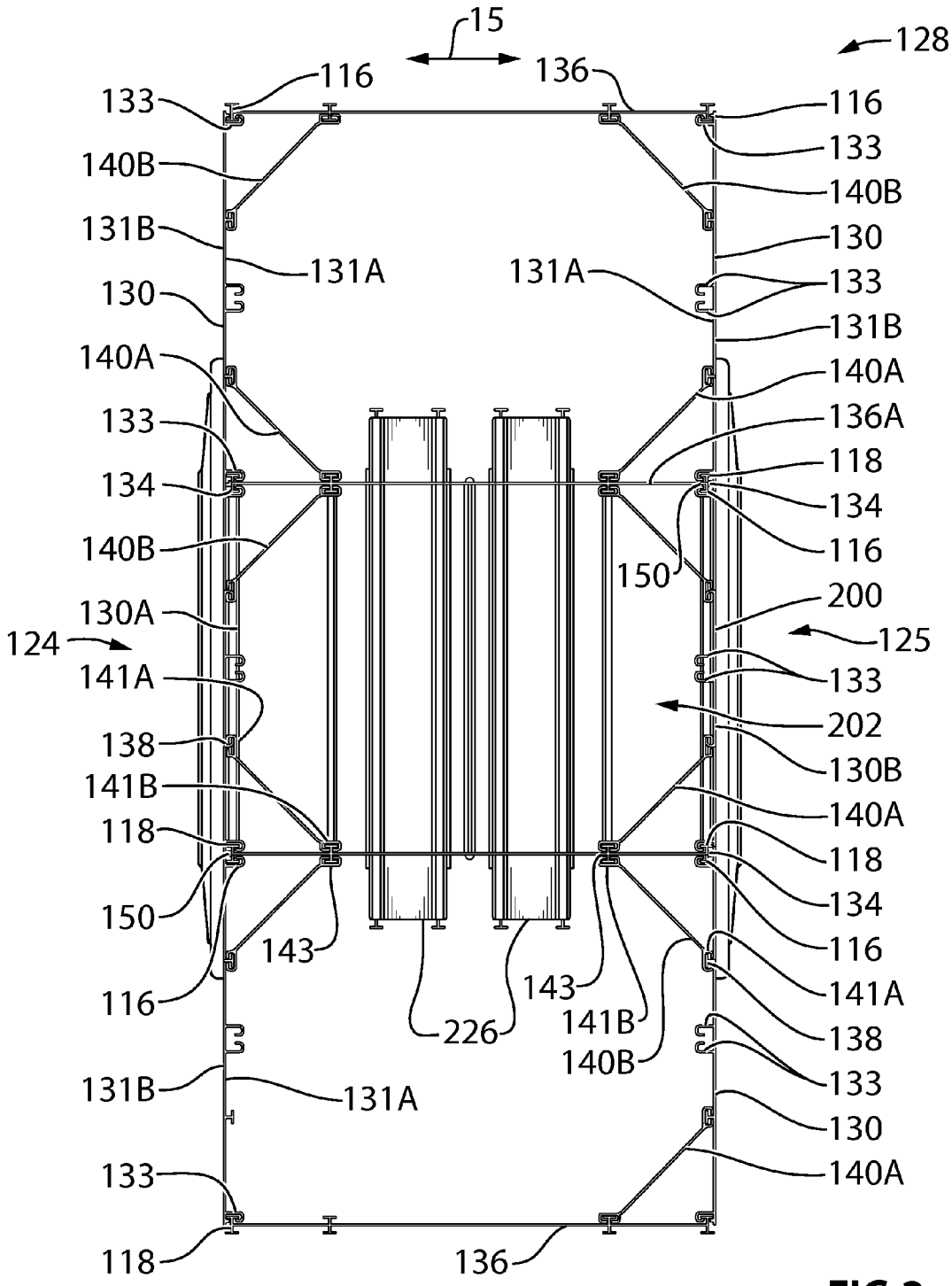
FIG. 2 is a top plan view of the FIG. 1 buck mounted in a cell of the FIG. 1 form.

FIGS. 1 and 2 show a modular stay-in-place form 128 having a buck 200 mounted therein. Form 128, including buck 200, may be used to fabricate a portion of a building or other structure having an opening 201 therethrough. Form 128 includes panels 130 and support members 136 which extend transversely between opposing panels 130. Support members 136 may brace opposing panels 130 and may, in some embodiments, also connect panels 130 to one another in edge-adjacent relationship. Form 128 may also optionally include tensioning members 140A, 140B (collectively, tensioning members 140) which extend angularly between panels 130 and support members 136 at various locations within form 128.

A buck 200 may be positioned between panels 130 of form 128 to block out (i.e. define) opening 201. In cases where form 128 is used to fabricate a building structure, opening 201 may comprise a building opening in which windows, doors, ventilation or other building component(s) may be installed after fabrication of the structure. In the illustrated embodiment, buck 200 is mounted in association with a cell 202 of form 128 defined by a pair of opposed panels 130A, 130B and opposed support members 136A, 136B. Buck 200 my be constructed or assembled from its various components, prior to positioning buck 200 in cell 202 of form 128. Buck 200 may be connected to various components of form 128, as described in further detail below.

Figure 3:
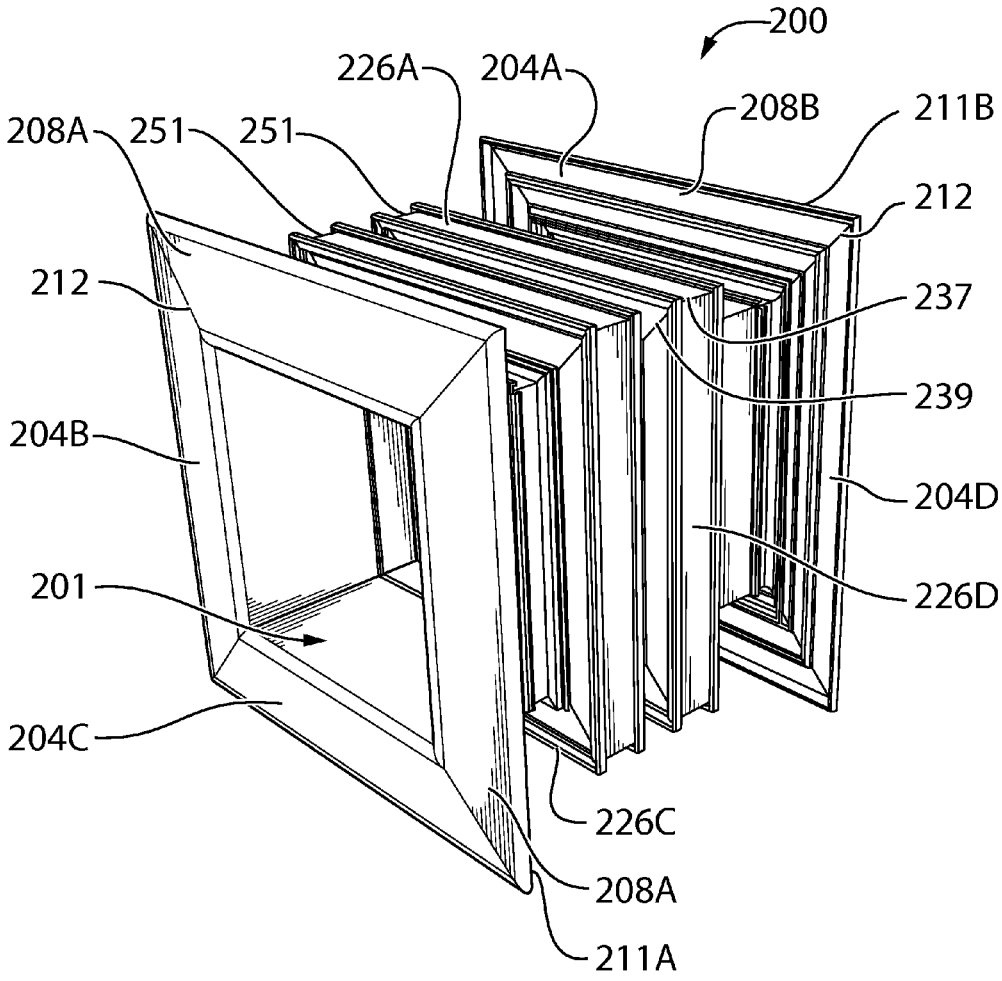
FIG. 3 is a perspective view of the FIG. 1 buck.

In the illustrated embodiment, as best seen in FIG. 3, buck 200 comprises top and bottom frame members 204A, 204C and a pair of opposed side frame members 204B, 204D (collectively, frame members 204) which may be arranged in abutting relationship such that adjacent frame members 204 extend at right angles to one another to define a substantially rectangular opening 201 in form 128. The rectangular shape defined by frame members 204 is not necessary. In other embodiments, frame members 204 may be arranged in abutting relationship, with appropriate miter joints, to define an polygonal openings 201, for example. In some embodiments, frame members 204 may be curved to provide corresponding curved openings 201.

Figure 4A:
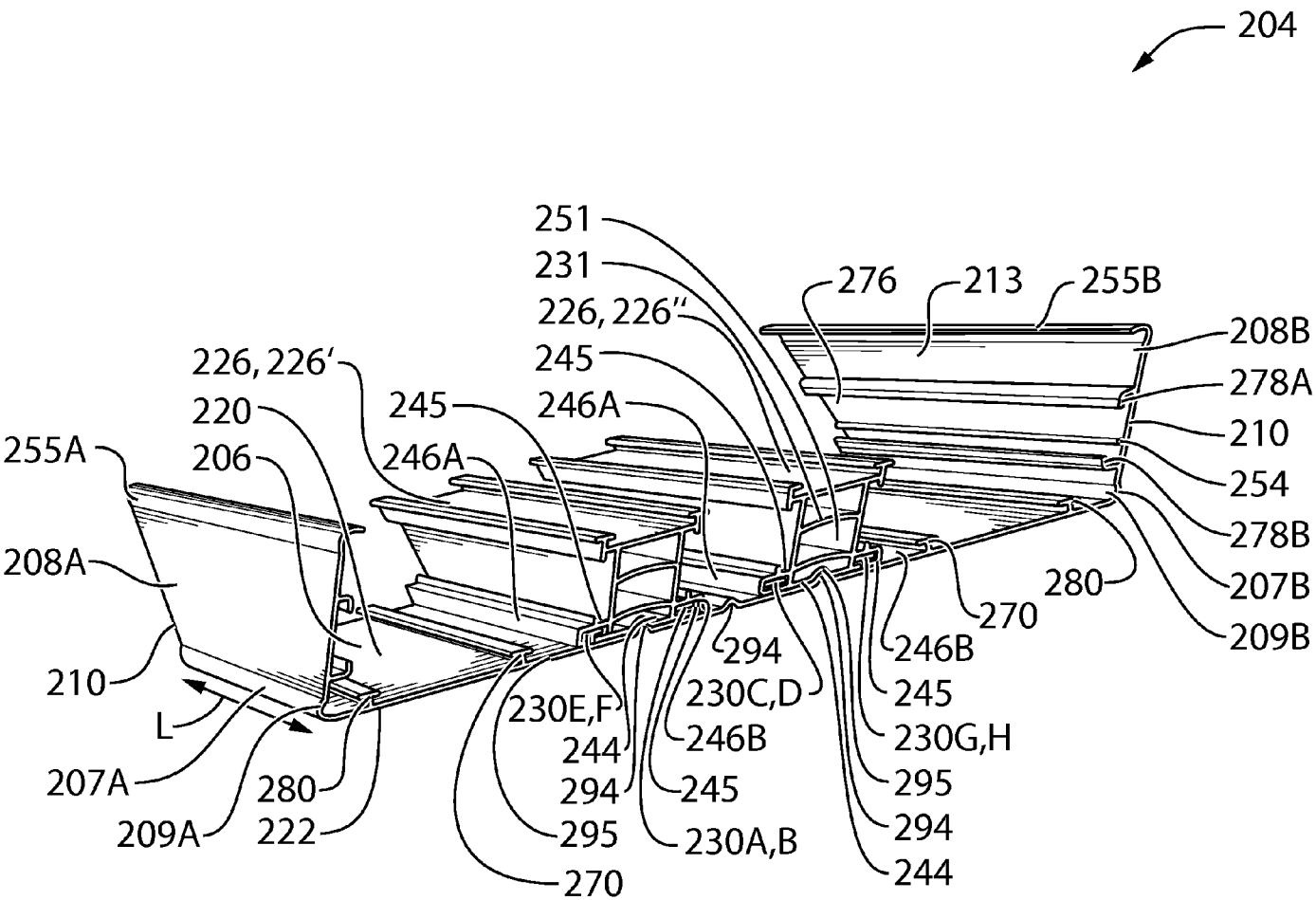
FIG. 4A is a perspective view of a frame member (shown with fastener-receivers connected thereto) which may be assembled with other like frame members to create the buck shown in FIGS. 1, 2 and 3.
Figure 4B:
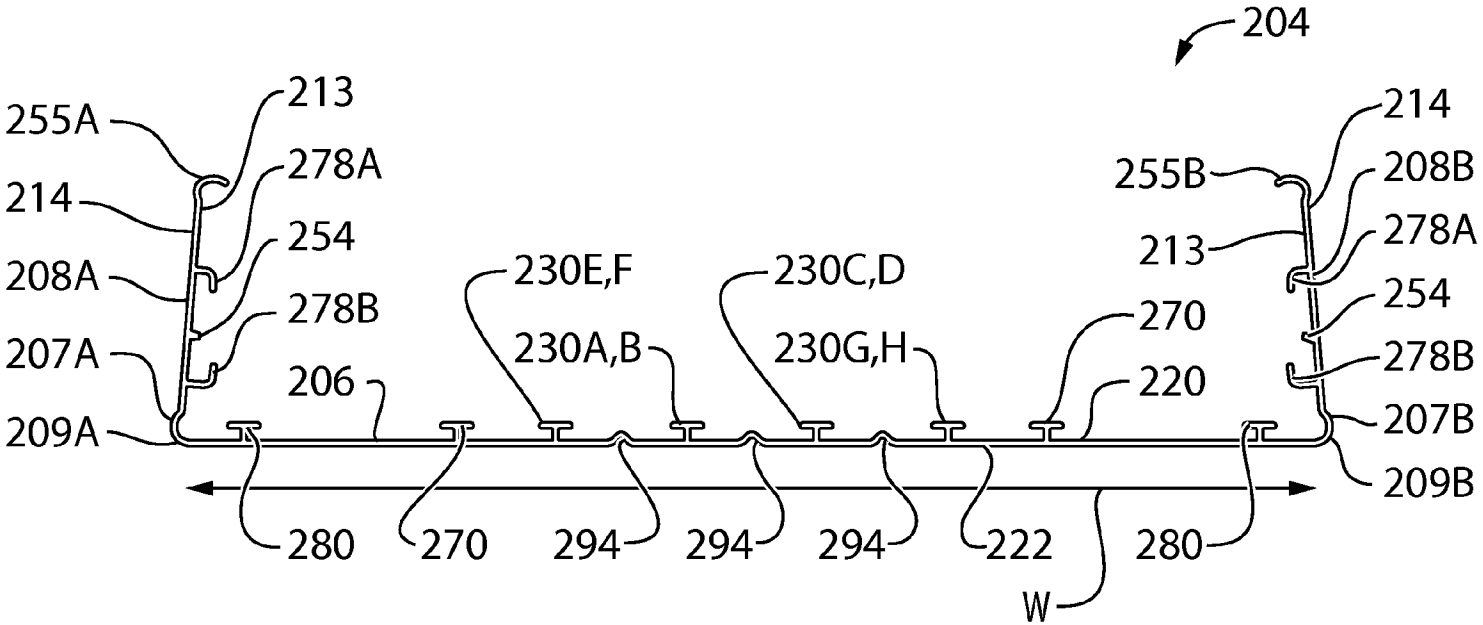
FIG. 4B is a side elevation view of the FIG. 4A frame member (shown without fastener-receivers connected thereto)

As best seen in FIGS. 4A and 4B, each frame member 204 of the illustrated embodiment includes a generally rectangular panel 206 and a pair of panel flanges 208A, 208B (collectively, flanges 208) extending from opposed longitudinally extending edges 207A, 207B (collectively, edges 207) of panel 206. Each flange 208 may be fabricated with, or cut to provide, a pair of mitered end edges 210, each of which abuts against, and forms a miter joint 212 with, a corresponding mitered end edge 210 of flange 208 of an adjacent frame member 204.

The length of opposed edges 207 of panel 206 defines a longitudinal dimension L of panel 206 (FIG. 4A), and the distance between opposed edges 207 of panel 206 defines a transverse dimension W of panel 206 (FIG. 4B). Dimension W of panel 206 is sized such that panel 206 spans a transverse distance (i.e. in the direction of the double-headed arrow 15 of FIG. 2) between opposed panels 130A, 130B of form 128. In the illustrated embodiment, as best seen in FIG. 3, dimension L of panel 206 is the same for all four frame members 204 to form a buck 200 defining a square opening 201. However, this is not necessary. Dimension L of panels 206 of frame members 204A, 204C may be different than dimension L of panels 206 of frame members 204B, 204D, so as to provide a rectangular opening 201. Dimensions L and W of panels 206 may be sized to define an opening 201 of the desired size, shape and configuration.

The components of form 128 (i.e. panels 130, support members 136 and tensioning members 140) and buck 200 (including fastener-receivers 226 and locking members 238 which are described below) may be fabricated from a lightweight and resiliently deformable material (e.g. a suitable plastic) using an extrusion process. By way of non-limiting example, suitable plastics include: poly-vinyl chloride (PVC), acrylonitrile butadiene styrene (ABS) or the like. In other embodiments, the components of form 128 may be fabricated from other suitable materials, such as steel or other suitable alloys, or wood composites, for example. Although extrusion is the currently preferred technique for fabricating the components of form 128, other suitable fabrication techniques, such as injection molding, stamping, sheet metal fabrication techniques or the like may additionally or alternatively be used.

Form 128 comprises a plurality of panels 130 which are elongated in the vertical direction (i.e. the direction into and out of the page of FIG. 2 and the direction of double-headed arrow 19 of FIG. 1). Panels 130 comprise inward facing surfaces 131A and outward facing surfaces 131B. In the illustrated embodiment of FIGS. 1 and 2, panels 130 are identical to one another, but this is not necessary. In general, panels 130 may have a number of features which differ from one another. In the illustrated embodiment, as best seen in FIG. 2, panels 130 have a substantially similar cross-section along their entire vertical length, although this also is not necessary and portions of panels 130 (e.g. connector components 133) may differ in shape along the length thereof.

As best seen in FIG. 2, support members 136 comprise connector components 134 at their edges for connecting to corresponding connector components 133 on panels 130. In the illustrated embodiment, connector components 134 at the edges of support members 136 are male T-shaped connector components 134 which slide into the receptacles of female C-shaped connector components 133 on inward surfaces 131A of panels 130.

In the illustrated embodiment, each panel 130 has vertically extending edges 116, 118 having terminal connector components 133 projecting transversely from inward-facing surface 131A of panel 130 (FIG. 2). A pair of edge-adjacent panels 130 may be joined together by connecting terminal connector components 133 at edges 116, 118 with connector components 134 of a support member 136 positioned between the edge-adjacent panels. In the illustrated embodiment, edge-adjacent panels 130 are joined together by sliding male T-shaped connector components 134 on support member 136 into the receptacles of female C-shaped terminal connector components 133 at edges 116, 118 of edge-adjacent panels 130, to form a connection 150 between edge-adjacent panels 130. Panels 130 may thereby be connected in edge-adjacent relationship to form first and second opposed form segments 124, 125 (FIG. 2).

In the illustrated embodiment of FIG. 2, each panel 130 comprises a terminal female C-shaped connector component 133 at each of edges 116, 118 and an additional pair of female interior connector components 133 at a location between edges 116, 118. Each pair of interior female connector components 133 on panels 130 is shaped to receive a corresponding pair of male connector components 134 from support members 136. Terminal and interior connector components 133 on panels 130 of the illustrated embodiment facilitate the connection of up to three support members 136 to each panel 130 (one support member 136 at each edge 116, 118, and an additional optional support member 136 between edges 116, 118). In other embodiments, panels 130 may be provided with any suitable number of connector components 133 to enable the connection of a corresponding number of support members 136, as may be necessary for the particular strength requirements of a given application. In addition, the mere presence of connector components 133 on panels 130 does not necessitate that support members 136 are connected to each such connector component 133. In general, the spacing of support members 136 may be determined as necessary for the particular strength requirements of a given application and to minimize undesirably excessive use of material.

Support members 136 are preferably apertured, as best seen in FIG. 1 (showing apertures 119 in support members 136), to allow liquid concrete to flow between support members 136 in order to fill the spaces between form segments 124, 125. Although not explicitly shown in the illustrated views, reinforcement bars (commonly referred to as rebar) may also be inserted into form 128 prior to introducing the liquid concrete in form 128. Where required or otherwise desired, transversely extending rebar can be inserted so as to extend through apertures 119 in support members 136. If desired, vertically extending rebar can then be coupled to the transversely extending rebar.

Form 128 of the illustrated embodiment also includes optional tensioning members 140 which extend angularly (e.g. at 45°) between support members 136 and panels 130 (FIG. 2). As seen in FIG. 2, tensioning members 140 comprise connector components 141A, 141B at their opposing edges. Connector components 141A on tensioning members 140 are complementary to connector components 138 on inward surfaces 131A of panels 130. In the illustrated embodiment, connector components 138 on panels 130 are male T-shaped connector components which slide into the receptacles of female C-shaped connector components 141A on tensioning members 140. Connector components 141B on tensioning members 140 are complementary to connector components 143 on support members 136. In the illustrated embodiment, connector components 143 on support members 136 are male T-shaped connector components which slide into the receptacles of female C-shaped connector components 141B on tensioning members 140.

Tensioning members 140 may comprise apertures 171 which allow concrete flow and the extension of rebar therethrough (see FIG. 1).

Tensioning members 140 may add to the strength of connections 150 between panels 130 and help to mitigate against so-called "unzipping" of connections 150 under the pressure of liquid concrete. More particularly, as seen in FIGS. 1 and 2, a pair of tensioning members 140A, 140B may extend at angles (e.g. at 45°) from a support member 136 to the panels 130 on either side of a connection 150 to reinforce the strength of the connection 150.

In some embodiments, tensioning members 140 are not necessary. Tensioning members 140 need not generally be used in pairs. In some embodiments, support members 136 and/or tensioning members 140 may be employed at different spacings within a particular form.

In other embodiments which are not illustrated, panels 130, support members 136 and optionally tensioning members 140 may be connected in alternate configurations while still providing forms 128, having a cell 202 (defined by opposed support members 136A, 136B and opposed panels 130A, 130B) in which a buck 200 may be mounted. For example, in one embodiment, panels 130 may be connected in edge-adjacent relationship by means of a connection 150 between a male connector component at one of edges 116, 118 of a panel 130, inserted into a female connector component at the other one of edges 116, 118 of an adjacent panel 130. In such embodiments, support members 136 are not required to connect edge-adjacent panels 130 together. However, support members 136 may be connected to interior connector components 133 on panels 130 at spaced apart locations from edges 116, 118 to provide support to form 128.

Buck 200 may be connected to or engaged with components of form 128 so that buck 200 is secured to form 128 as concrete is introduced into form 128 and is subsequently cured. Panel 206 of each frame member 204 of buck 200 has a first side 220 facing away from opening 201 and toward an interior of form 128, and a second side 222 facing toward opening 201 (FIG. 4B). Each flange 208 extends away from opening 201, and as best seen in FIG. 4B, has an inward surface 213 (facing toward outward surfaces 131B of panels 130) and an outward surface 214 (facing toward an exterior of form 128). When buck 200 is installed in form 128, inward surfaces 213 of flanges 208A, 208B abut against outward surfaces 131B of panels 130, as best seen in FIG. 2.

Flanges 208A, 208B may be angled slightly toward one other as they extend away from panel 206 (as best seen in FIG. 4B) so that flanges 208A, 208B may be pushed apart as they engage with outward surfaces 131B of panels 130. The incline of flanges 208A, 208B allows buck 200 to accommodate a range in the transverse dimension of form 128. Also, as flanges 208A, 208B are pushed apart by engagement with outward surfaces 131B of panels 130, restoration forces associated with the deformation of flanges 208A, 208B, combined with the frictional forces between flanges 208A, 208B and outward surfaces 131B of panels 130, act to retain buck 200 in position within form 128 as shown in FIGS. 1 and 2.

In certain embodiments, buck 200 may be secured to form 128 only by means of the interaction of panel flanges 208 with panels 130 as described above. In other embodiments, panel flanges 208 may be coextruded or otherwise coated with a suitable soft deformable material on at least a portion of inward surfaces 213 of panel flanges 208. The coextrusion material may comprise, for example, one or more soft deformable tongues projecting from inward surfaces 213 of panel flanges 208, between terminal edge portions 255 and locking flanges 278A. The coextruded material abuts against, and assists in gripping, outward surfaces 131B of panels 130.

As seen in FIG. 3, flanges 208A (when connected to one another at miter joints 212) collectively form a frame 211A for abutting against outer surfaces 131B of panels 130A, and flanges 208B (when connected to one another at miter joints 212) collectively form a frame 211B for abutting against outer surfaces 131B of panels 130B.

As shown in FIGS. 4A and 4B, panel 206 has a plurality of connector components on first side 220. These connector components may include:

- connector components 230 for connecting to complementary connector components 245 on fastener-receivers 226;
- connector components 270 for connecting to complementary connector components 141B on optional tensioning members 140; and
- connector components 280 for connecting to complementary connector components 133 on panels 130.

In the illustrated embodiment, these connector components 230, 270, 280 on first side 220 of panel 206 are male T-shaped connector components which slidably engage complementary C-shaped connector components 245, 141B, 133 of fastener-receivers 226, tensioning members 140 and panels 130. It will be appreciated, however, that other suitable connector components could be used. For example, some of connector components 230, 270, 280 could be female connector components for engaging complementary male connector components and/or connector components 230, 270, 280 may use coupling techniques other than sliding (e.g. deformation and restorative deformation forces which provide a "snap-together" coupling).

As seen in FIG. 4A, frame members 204 may include at least one set of connector components 230 for connecting to connector components 245 on fastener-receivers 226. However, if fastener-receivers 226 are not used with buck 200, connector components 230 are not necessary on frame members 204. Also, it is not necessary for all frame members 204 to have connector components 270 and 280 if frame members 204 are not connected to tensioning components 140 or to panels 130. For example, in some embodiments, top and bottom frame members 204A, 204C do not have connector components 270, 280. On the other hand, as seen in FIG. 4A, side frame members 204B, 204D have connector components 270, 280 on panel 206 for connecting such frame members to complementary connector components on specific components of form 128 (e.g. tensioning members 140 and panels 130). Connector components 270 and 280 may still be present on frame members 204 even if they are not used to make corresponding connections, as connector components 270, 280 may assist in anchoring frame members 204 to the concrete which is introduced into form 128. Each of these connector components will be explained in further detail below.

Buck 200 of the illustrated embodiment includes a plurality of fastener-receivers 226 which are mounted to first sides 220 of panels 206 by the connection of connector components 245 on fastener-receivers 226 with complementary connector components 230 on first sides 220 of panels 206 of frame members 204. Fastener-receivers 226 extend along a longitudinal dimension L of each panel 206 (see FIG. 4A) and may be connected to panels 206 to form one or more fastener-receiving frames 251 around buck 200 (see FIGS. 2, 3). In the illustrated embodiment of FIGS. 1, 2 and 3, buck 200 has two fastener-receiving frames 251 mounted to panels 206 of frame members 204. Each fastener-receiving frame 251 may comprise one fastener-receiver 226 corresponding to each of frame members 204 (e.g. top and bottom fastener-receivers 226A, 226C and side fastener-receivers 226B, 226D, or collectively, fastener-receivers 226). In the illustrated embodiment, as best seen in FIG. 3, each fastener-receiver 226 is fabricated with, or cut to provide, a pair of mitered edge portions 237 for abutting against, and forming a miter joint 239 with, corresponding mitered edge portions 237 of adjacent fastener-receivers 226.

Fastener-receiving frame 251 may have several functions, including:

- holding adjacent frame members 204 together and providing structural reinforcement (e.g. rigidity, stability) to buck 200;
- providing structural reinforcement to form 128;
- providing a thermally insulating barrier around a window, door or other component installed within opening 201 (as described in further detail below); and
- providing a structure in buck 200 to which a window, door or other component may be mounted within opening 201 after the concrete cures in form 128.

It is not necessary for fastener-receiving frame 251 to extend completely around the perimeter of buck 200 as seen in FIG. 3. In some embodiments, fastener-receiving frame 251 extends partially around particular sections of buck 200 and is absent in other sections of buck 200.

Figure 5A:
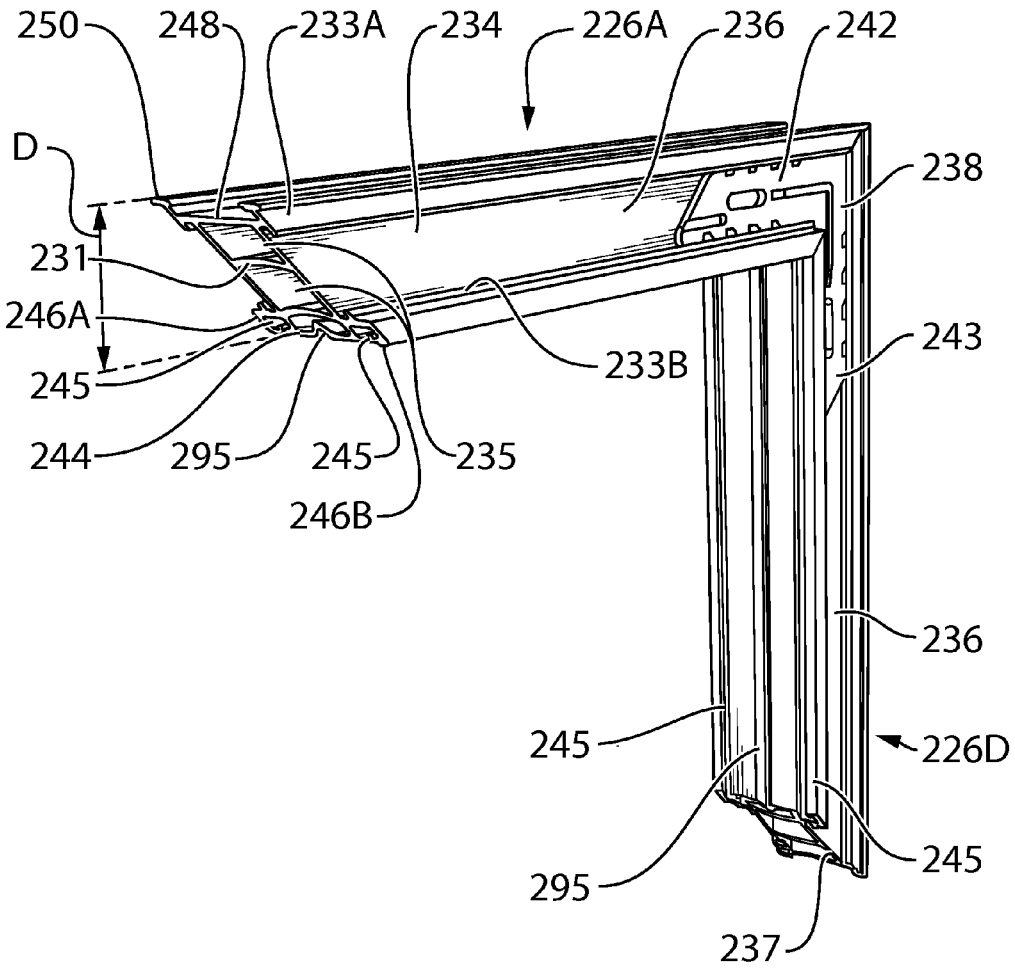
FIGS. 5A and 5B are partial perspective views of fastener-receivers shown joined together at a miter joint, and in a vertically stacked configuration, respectively, which may be used with the FIG. 1 buck.
Figure 5B:
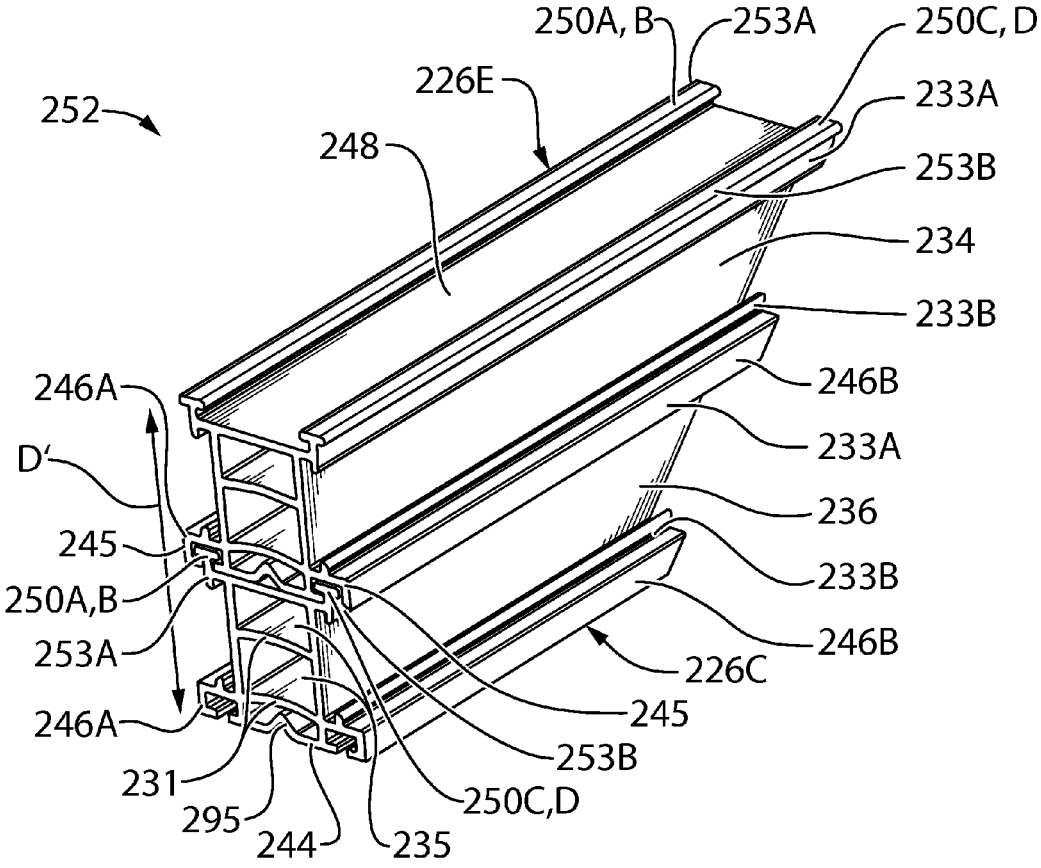

As best seen in FIGS. 5A and 5B, fastener-receivers 226 have opposed, longitudinally extending locking sides 234 which extend along and away from panels 206. Each locking side 234 has a longitudinally extending channel 236 for slidably receiving a locking member 238 (FIG. 5C) to connect adjacent fastener-receivers 226. In the illustrated embodiment, channel 236 is defined by a surface of locking side 234 and a pair of opposed locking flanges 233A, 233B (collectively, locking flanges 233). In the illustrated embodiment, locking flanges 233 extend transversely from locking side 234 (at locations proximate the longitudinally extending edges of locking side 234) and toward one another.

Figure 5C:
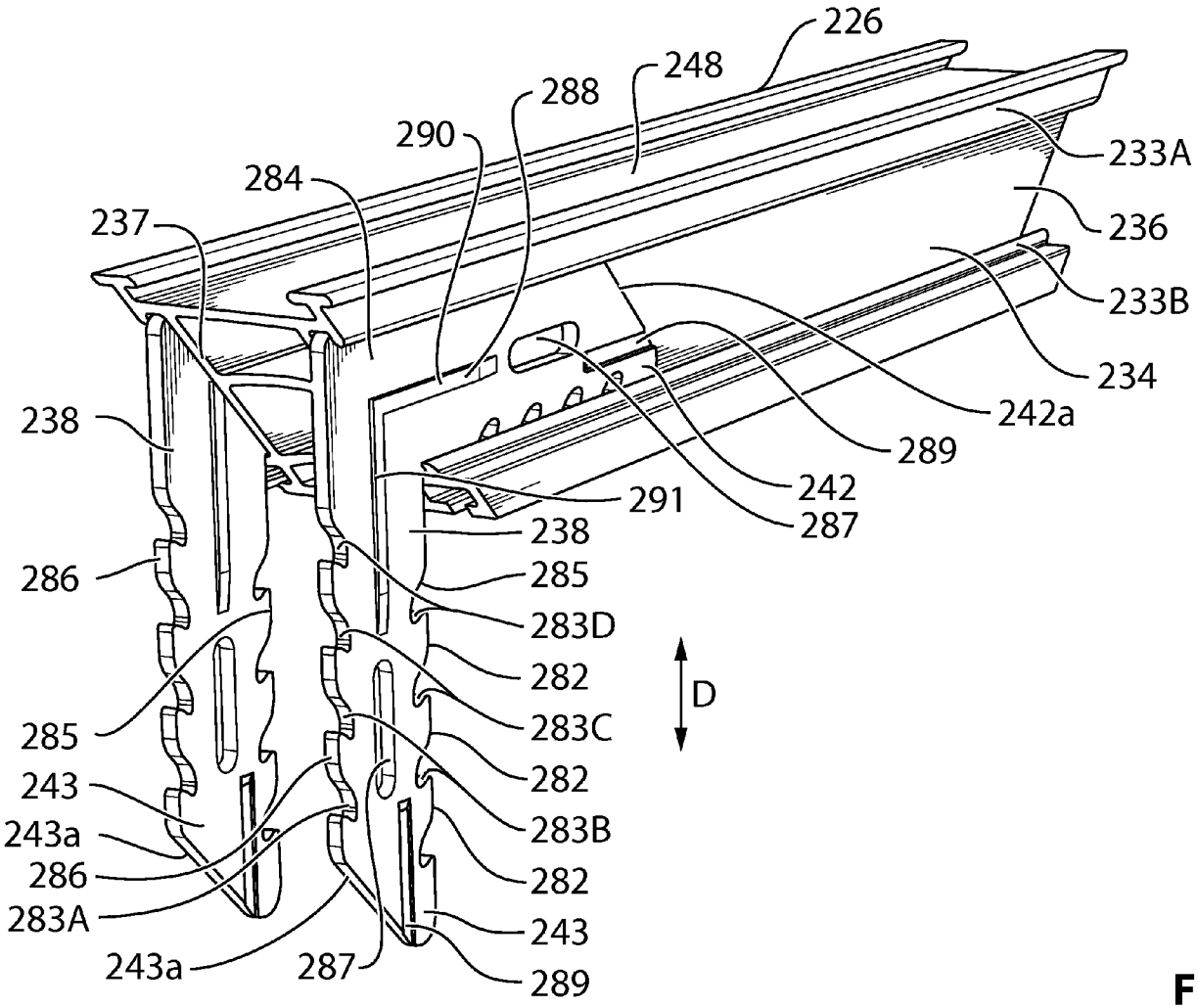
FIG. 5C is a perspective view of two locking members each having one arm portion inserted in a fastener-receiver.

Locking member 238 may be generally L-shaped as shown in FIG. 5C. As shown in FIG. 5A, locking member 238 includes a first arm portion 242 for insertion in channel 236 of a fastener-receiver 226 (fastener-receiver 226A, for example) and a second arm portion 243 for insertion in channel 236 of an adjacent fastener-receiver 226 (fastener-receiver 226D, for example). Arm portions 242, 243 meet at arm intersection portion 284 (see FIG. 5C). Arm portions 242, 243 may be sized so that when arm portions 242, 243 are in their fully inserted positions in their respective channels 236, edge portions 237 of fastener-receivers 226A, 226D meet to form miter joint 239 and locking member 238 retains fastener-receivers 226A, 226D in a locked position as a result of frictional and/or restorative deformation forces acting between the abutting surfaces of fastener-receivers 226A, 226D and locking member 238. Four or eight L-shaped locking members 238 (one or two locking members 238 for each miter joint 239) may be used to connect together four fastener-receivers 226A, 226B, 226C, 226D to form fastener-receiving frame 251.

As seen in FIG. 5C, a plurality of notches 283 (which define a plurality of teeth 282) may optionally be provided along longitudinally extending edges 285, 286 of each of arm portion 242, 243 of locking member 238. In the illustrated embodiment, notches 283 are arranged as pairs of opposed offset notches 283A, 283B, 283C, 283D (collectively, notches 283). For example, notch 283A along edge 285 of arm portion 243 may be offset from notch 283A along edge 286 of arm portion 243 by a longitudinal distance d (FIG. 5C) such that as arm portion 243 is slid into channel 236 starting from mitered edge portion 237, each offset pair of notches 283A, 283B, 283C, 283D reaches mitered edge 237 at approximately the same time. One or more apertures 287 may also optionally be defined in each arm portion 242, 243 at location(s) spaced apart from arm intersection portion 284. When locking member 238 is lockingly positioned in channels 236 of adjacent fastener-receivers 226, screws or other fasteners may project through apertures 287 and into locking sides 234 for securely fastening locking member 238 to fastener-receivers 226.

As seen in FIG. 5C, one or more indentations 289 may also be optionally defined in arm portions 242, 243 of locking member 238, at location(s) on arm portions 242, 243 spaced apart from arm intersection portion 284. In the illustrated embodiment (FIG. 5C), indentations 289 comprise elongate grooves extending from outer ends 242*a*, 243*a* of arm portions 242, 243 along a partial length of arm portions 242, 243.

Notches 283, apertures 287 and indentations 289, as described above and shown in FIG. 5C, may provide the following additional functions, for example:

- reducing the frictional contact between the surfaces of locking member 238 and fastener-receivers 226 to facilitate the initial sliding of locking member 238 into channels 236;
- reducing the rigidity of arm portions 242, 243 to make it easier to deform arms 242, 243 and thereby easier to insert locking member 238 into channels 236; and
- providing cavities which may be filled by some concrete, thereby facilitating the adhesion of concrete to buck 200.

Locking member 238 may also have grippers 288 (see FIG. 5C) protruding transversely from the sides of arm portions 242, 243 to help to engage with locking sides 234 of adjacent fastener-receivers 226. In the illustrated embodiment of FIG. 5C, each gripper 288 has a gripping arm 290 extending longitudinally along arm portion 242 and a gripping arm 291 extending longitudinally along arm portion 243. Gripping arms 290, 291 meet at arm intersection portion 284 of locking member 238. Gripping arms 290, 291 may be transversely wider in sections closer to arm intersection portion 284 and narrower in sections closer to the ends of arm portions 242, 243. For example, gripping arms 290, 291 may have beveled (i.e. ramping) edges as shown best in FIG. 5C. Thus, as arm portions 242, 243 are slid into their respective channels 236 of adjacent fastener-receivers 226, the transverse protrusion of gripper 288 increases frictional and deformation forces acting between abutting surfaces of locking member 238 and fastener-receivers 226 and causes arm portions 242, 243 to be wedged more snugly in channels 236 of fastener-receivers 226. In the illustrated embodiment, gripping arms 290, 291 extend along a partial length of arm portions 242, 243, stopping short of outer ends 242*a*, 243*a* of arm portions 242, 243, so that initially, as arm portions 242, 243 are slid into channels 236, arm portions 242, 243 are met with no resistance from gripping arms 290, 291. The "wedging" of arm portions 242, 243 in channels 236 may begin when arm portions 242, 243 are inserted a sufficient distance into channels 236 so that the beveled edges of gripping arms 290, 291 begin to contact locking sides 234. The transverse protrusion of gripping arms 290, 291 may increase toward arm intersection portion 284 to increase the frictional and deformation forces as arm portions 242, 243 approach their fully inserted positions in channels 236.

In some embodiments, a gripper 288 is provided on only one surface of arm portions 242, 243 (i.e. the surface facing toward fastener-receiver 226). However, in the illustrated embodiment of FIG. 5C, a gripper 288 is provided on each of the opposed surfaces of arm portions 242, 243 so that one of grippers 288 engages with locking side 234 regardless of which of the surfaces of arm portions 242, 243 is facing fastener-receiver 226 as locking member 238 is inserted in channel 236.

In other embodiments, gripper 288 may have a different shape. For example, in the illustrated embodiment of FIG. 5C, there is only one gripper 288 on each of the opposed surfaces of locking member 238. In other embodiments, locking member 238 may comprise a plurality of transversely extending gripper protrusions on each of arm portions 242, 243 for engaging with locking sides 234 of adjacent fastener-receivers 226. To increase the frictional and deformation forces as arm portions 242, 243 approach their fully inserted positions in respective channels 236 of adjacent fastener-receivers 226, gripper(s) may be provided with more and/or larger protrusions at locations closer to arm intersection portion 284. Likewise, to facilitate the initial part of the insertion of arm portions 242, 243 into channels 236 of adjacent fastener-receivers 226, gripper(s) may be provided with less and/or smaller protrusions and/or beveled edges at locations away from arm intersection portion 284. In still other embodiments, instead of or in addition to specific gripper feature(s), arm portions 242, 243 may be shaped to have an increased transverse dimension toward arm intersection portion 284 to increase the frictional and deformation forces as arm portions 242, 243 approach their fully inserted positions in respective channels 236 of adjacent fastener-receivers 226.

Figure 5D:
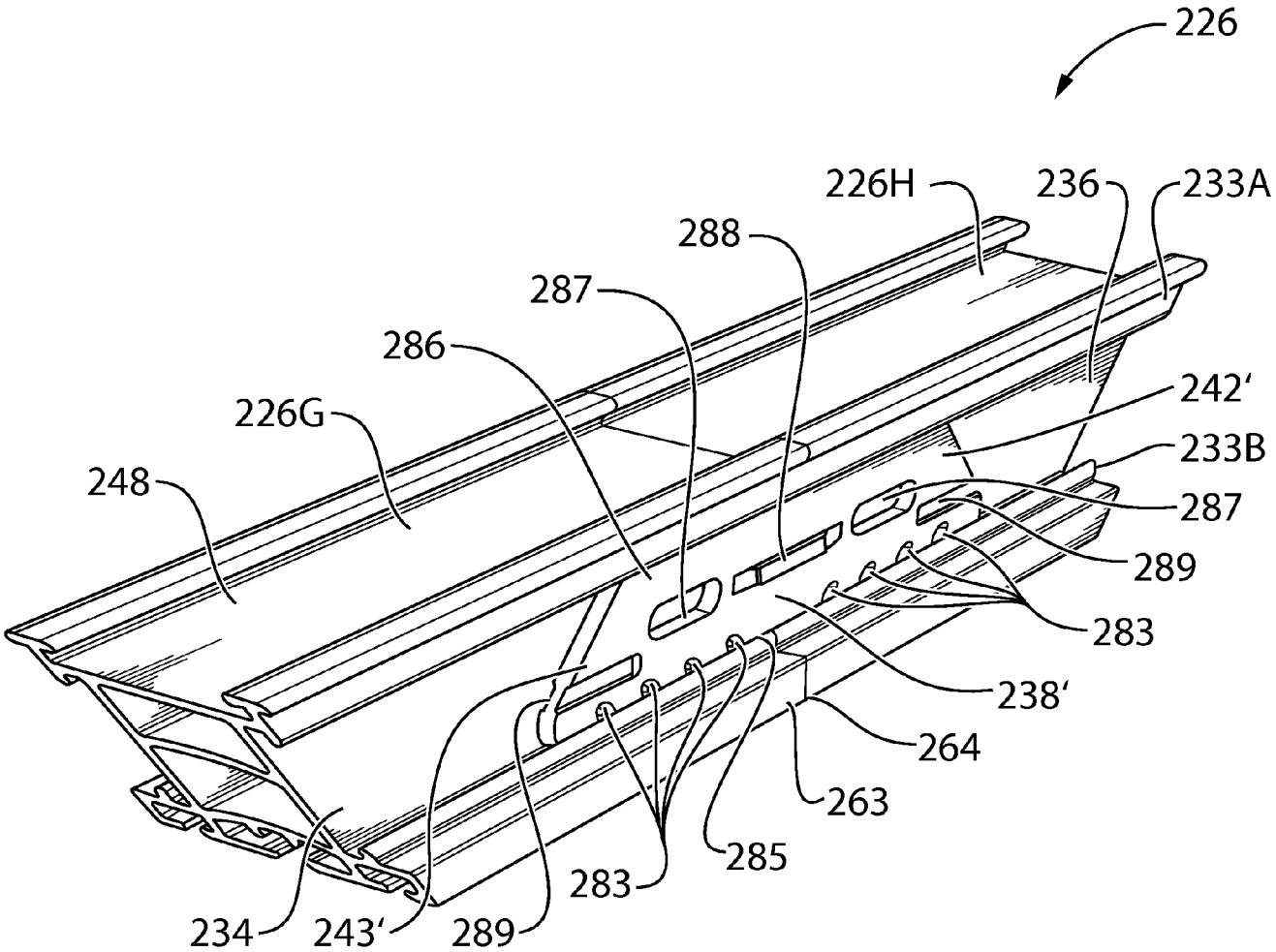
FIG. 5D is a perspective view of a locking member according to another embodiment of the invention, shown connecting two fastener-receivers together.

In some embodiments, two or more fastener-receivers 226 may be longitudinally connected together to form one fastener-receiver 226 for connecting to panels 206 of frame members 204. FIG. 5D shows two fastener-receivers 226G, 226H longitudinally connected together to form one fastener-receiver 226. An end edge portion 263 of fastener-receiver 226G abuts against an end edge portion 264 of fastener-receiver 226H. In the illustrated embodiment of FIG. 5D, fastener-receivers 226G, 226H may be retained in an abutting relationship by a locking member 238'. Locking member 238' may be inserted in channels 236 at one or both of sides 234 of adjacent fastener-receivers 226G, 226H to span the connection between edge portions 263, 264. Locking member 238' includes similar features to those of locking member 238 of FIG. 5C, except that locking member 238' is generally shaped as an elongate piece having opposed arms 242', 243', but without a corner between arms 242', 243'.

Fastener-receiver 226 has a longitudinally extending first mounting side 244 oriented generally perpendicularly to sides 234 and facing toward panel 206 (FIGS. 5A, 5B). First mounting side 244 comprises connector components 245 that are complementary to connector components 230 on panels 206 of frame members 204. In the illustrated embodiment of FIGS. 4A and 4B, frame member 204 has four spaced apart of connector components 230 (i.e. 230A-B; 230C-D; 230E-F; 230G-H). The spacing between pairs of connector components 230A-B; 230C-D; 230E-F; 230G-H may accommodate the mounting of either a single fastener-receiving frame 251 or two parallel fastener-receiving frames 251. If two fastener-receiving frames 251 are to be mounted, as seen in FIG. 4A, female C-shaped connector components 245 of fastener-receivers 226 comprising the first fastener-receiving frame 251 may be connected to male T-shaped connector components 230E-F and 230A-B on frame member 204 and female C-shaped connector components 245 of fastener-receivers 226 comprising the second fastener-receiving frame 251 may be connected to male T-shaped connector components 230C-D and 230G-H on frame member 204 (FIG. 4A). If only a single fastener-receiving frame 251 is to be mounted to frame member 204 (not shown), female C-shaped connector components 245 of fastener-receivers 226 may be connected to male T-shaped connector components 230A-B and 230C-D on frame member 204 (for a centrally located fastener receiver 226) or to either of the pairs of connector components 230E-F and 230A-B or 230C-D and 230G-H (for a fastener receiver 226 located relatively close to one side of buck 200).

In the illustrated embodiment of FIG. 4A, two fastener-receivers 226', 226" (forming two fastener-receiving frames 251 mounted in parallel around buck 200) are connected to connector components 230 on panels 206 of frame members 204. A male T-shaped connector component 230E-F on first side 220 of frame member 204 slides into a corresponding receptacle of female C-shaped connector components 245 at edge 246A of first mounting side 244 of fastener-receiver 226'. Another male T-shaped connector component 230A-B on first side 220 of frame member 204 slides into a corresponding receptacle of another female C-shaped connector components 245 at edge 246B of first mounting side 244 of fastener-receiver 226'. Similarly, a male T-shaped connector component 230C-D on first side 220 of frame member 204 slides into a corresponding receptacle of female C-shaped connector component 245 at edge 246A of first mounting side 244 of fastener-receiver 226". Another male T-shaped connector component 230G-H on first side 220 of frame member 204 slides into a corresponding receptacle of another female C-shaped connector component 245 at edge 246B of first mounting side 244 of fastener-receiver 226".

As seen in FIG. 4A, a longitudinally extending ridge 294 protruding from first side 220 of panel 206 and indented from the opposing side 222 of panel 206 may be located midway between adjacent connector components 230 on panel 206. Each ridge 294 is shaped for sliding into a corresponding longitudinally extending groove 295 on first mounting side 244 of fastener-receiver 226. Ridges 294 may have several functions, including, for example:

- acting as an additional connection component to connect fastener-receiver 226 to frame member 204;
- increasing the contacting surface area between first side 220 of panel 206 and first mounting side 244 of fastener-receiver 226 (thereby helping fastener-receiver 226 to be more securely retained on panel 206); and
- serving as an indicator of the position of fastener-receivers 226 on panel 206 which may be seen from side 222 of panel 206. Such indicators may be used to guide the proper alignment of the window, door or other component mounted within opening 201 and the locations at which fasteners may be inserted. For example, in the illustrated embodiment of FIG. 4A, to ensure that a fastener is inserted into fastener-receivers 226', 226", one or more fasteners may be inserted perpendicularly to panel 206 and into the side 222 groove corresponding to ridge 294 located between connector components 230E-F and 230A-B. Other fastener(s) may be inserted perpendicularly to panel 206 and into the side 222 groove corresponding to ridge 294 located between connector components 230C-D and 230G-H.

In some embodiments, first mounting side 244 of fastener-receiver 226 may have ridges, bumps or other outward protrusions, or have a convex curved surface, for more securely retaining fastener-receiver 226 to panel 206 of frame member 204. When fastener-receiver 226 is slidably connected to connector components 230 on panel 206 of frame member 204, the protrusions or curvature on first mounting side 244 of fastener-receiver 226 may result in deformation of first mounting side 244 and corresponding restorative and frictional forces acting between first mounting side 244 of fastener-receiver 226 and first side 220 of panel 206.

In the illustrated embodiment, fastener-receivers 226 may be connected to panels 206 of buck 200 and to one another by way of connector components 230, 245 and locking members 238 described above with reference to FIGS. 4A and 4B, to form one or more fastener-receiving frames 251 mounted at least partially around a perimeter of buck 200. In other embodiments, fastener-receivers 226 may be connected to panels 206 of buck 200 in other suitable ways to form one or more fastener-receiving frames 251 around buck 200.

Fastener-receiving frame 251 provides stability and rigidity to buck 200, and also to frame 128. Fastener-receiving frame 251 also provides a structure for receiving and anchoring fasteners (e.g. screws, nails, etc.) used to mount a window, door or other building component within the opening 201 defined by buck 200. To avoid the difficulties associated with anchoring fasteners into cured concrete, fastener-receiving frame 251 preferably has a sufficient depth D (FIG. 5A) to accommodate the length of the fasteners used, so that the fasteners do not extend past fastener-receiving frame 251 into the concrete surrounding buck 200. The depth D of fastener-receivers 226 may be relatively deep for larger openings 201 and for mounting correspondingly larger windows, doors, or the like.

Fastener-receivers 226 may comprise one or more longitudinally extruded internal fastener-retaining members 231, which along with outer mounting sides 244, 248 define a plurality of chambers 235 therebetween (FIGS. 4A and 5A). Chambers 235 may act as a thermally insulating barrier between the concrete and the window, door or other component mounted within buck 200. Fastener-retaining members 231 add to the structural strength of fastener-receivers 226. Fastener-retaining members 231 also provide additional mounting walls for more securely anchoring fasteners which are received in fastener-receivers 226. For example, a fastener may project through, and thereby be anchored to, first mounting side 244 and one or more fastener-retaining members 231. The end of the fastener may project into one of chambers 235. Fastener-retaining members 231 may have a curved or bent shape which is convex in a direction away from panels 206 of frame members 204. When a fastener (e.g. a screw or nail) is projected through panel 206 and through one or more fastener-retaining members 231, this convex shape may make it relatively more difficult to withdraw the fastener from such fastener-retaining members 231.

If desired, two or more fastener-receivers 226 may be stacked and coupled together to form a fastener-receiving frame 251 having a greater total depth D' (FIG. 5B). This may be desirable where the fasteners used to mount the window or door within buck 200 are longer than a depth D of a single fastener-receiver 226 (for example, as may be desirable to mount heavier doors and windows). To enable fastener-receivers 226 to be stacked and coupled together, each fastener-receiver 226 incorporates a longitudinally extending second mounting side 248 (oriented perpendicularly to sides 234 and facing away from panel 206) which may be provided with connector components 250. Connector components 250 are complementary to connector components 245 on first mounting side 244 of another fastener-receiver 226. As shown in FIG. 5B, two fastener-receivers 226C, 226E may be coupled together by slidably connecting connector components 250 of one fastener-receiver 226C to connector components 245 of the other fastener-receiver 226E, forming a fastener-receiving unit 252 having a total depth D'. In the illustrated embodiment, male T-shaped connector component 250A-B at edge 253A of second mounting side 248 of fastener-receiver 226C slides into the corresponding receptacle of female C-shaped connector components 245 at edge 246A of first mounting side 244 of fastener-receiver 226E Likewise, male T-shaped connector component 250C-D at edge 253B of second mounting side 248 of fastener-receiver 226C slides into the corresponding receptacle of another female C-shaped connector component 245 at edge 246B of first mounting side 244 of fastener-receiver 226E.

In some embodiments, fastener-receivers 226 may be adapted to act as a holder or receiver of suitable insulating and/or reinforcing material for providing insulation and/or structural reinforcement to buck 200 and form 128. For example, fastener-receivers 226 may have a space between opposed sides 234 for receiving a foam insulating material. Additionally or alternately, a reinforcing strip may be secured between opposed sides 234 or to second mounting side 248 of fastener-receiver 226.

Buck 200 may incorporate a locking mechanism for connecting edge-adjacent panel flanges 208 of adjacent frame members 204. In the illustrated embodiment, as seen in FIG. 4A, a channel 276 is provided on each of panel flanges 208A, 208B. Channel 276 may be similar to channel 236 of fastener-receiver 226 and may receive a locking member 238. Channel 276 is defined by inward surface 213 of flange 208 and locking flanges 278A, 278B (collectively, locking flanges 278) which project transversely from inward surface 213 and toward one another. An optional ridge 254, projecting transversely from inward surface 213 may extend longitudinally between locking flanges 278A, 278B. A locking member 238 (of the type shown in FIG. 5C) may be inserted in channels 276 to connect edge-adjacent panel flanges 208 in a similar fashion as described above with respect to insertion of locking member 238 into channels 236 to connect adjacent fastener-receivers 226. In particular, arm portions 242, 243 of locking member 238 may be inserted into respective channels 276 of edge-adjacent panel flanges 208. As arm portions 242, 243 are slid into channels 276, the transverse protrusion of gripper 288 on arm portions 242, 243, combined with the transverse protrusion of ridge 254 on inward surface 213 of panel flanges 208, results in frictional and restorative deformation forces acting between the surfaces of locking member 238 and panel flanges 208. Locking member 238 is thereby wedged snugly in channels 276 of edge-adjacent panel flanges 208, and retains edge-adjacent panel flanges 208 in an abutting relationship.

Locking flanges 278 may also provide a drainage conduit for collecting and carrying away moisture that is received in channel 276 between the surfaces of channel 276 and locking member 238. For example, moisture received in channel 276 of panel flange 208A of frame member 204D may be collected by locking flange 278B and allowed to drain out a lower end of locking flange 278B, at miter joint 212 between frame members 204C and 204D (FIG. 3).

In the illustrated embodiment, as seen in FIGS. 4A and 4B, frame members 204 include drainage channels 209A, 209B (collectively drainage channels 209) between panel 206 and flanges 208. Drainage channels 209A, 209B extend along edges 207A, 207B respectively, for collecting and carrying away moisture which may be received on first sides 220 of panels 206, or between inward surfaces 213 of flanges 208 and outward surfaces 131B of panels 130. In the illustrated embodiment, drainage channels 209 protrude generally outwardly toward an exterior of form 128 to help collect moisture and transport it away from flanges 208 and panels 206. When buck 200 is assembled, drainage channels 209A are in communication with one another to provide a continuous drainage circuit extending around frame 211A formed by flanges 208A and similarly, drainage channels 209B are in communication with one another to provide a continuous drainage circuit extending around frame 211B formed by flanges 208B. As a result, water which collects in drainage channel 209A of top frame member 204A, for example, may be carried toward either of drainage channels 209A of side frame members 204B, 204D, and subsequently drained at a lower end of drainage channels 209A of frame members 204B or 204D.

In the illustrated embodiment, as best seen in FIG. 4B, the terminal longitudinal edge portions 255A, 255B of flanges 208 may curl toward each other. The shape of edge portions 255A, 255B may have one or more of the following functions:

- providing a drainage gap between flanges 208 and outer surfaces 131B of panels 130; and
- providing a repository for the placement of sealant, caulk and/or the like between flanges 208 and outer surfaces 131B of panels 130, for forming a seal which is impermeable to water, debris, dust, etc.

In operation, as best seen in FIG. 2, form 128 may be used to fabricate a structure (e.g. a building structure, a portion thereof or some other structure) by slidably connecting connector components 133 of edge-adjacent panels 130 to connector components 134 on support members 136 to make connections 150 between edge-adjacent panels 130. If it is desired to include tensioning members 140, tensioning members 140 may be attached between connector components 143 on support members 136 and connector components 138 on panels 130. Panels 130 and support members 136 may generally be connected to one another in any orientation. Panels 130, connector components 138 and optional tensioning members 140 may be assembled in place or may be pre-assembled and placed in a desired orientation (e.g. vertical) after such assembly.

Buck 200 may be assembled from its various components (frame members 204, fastener-receivers 226 and locking members 238) while positioning buck 200 in cell 202 of form 128 or prior to positioning buck 200 in cell 202 of form 128. Buck 200 may be assembled by slidably connecting connector components 245 on fastener-receivers 226 to connector components 230 on frame members 204 (see FIG. 4A). One of arm portions 242, 243 of a locking member 238 may be inserted in a channel 236 of a fastener-receiver 226 (see FIG. 5C). The other one of arm portions 242 and 243 of locking member 238 may be inserted in a channel 236 of an edge-adjacent fastener-receiver 226, thereby connecting together edge-adjacent fastener-receivers 226. Similarly, one of arm portions 242, 243 of a locking member 238 may be inserted in a channel 276 of a panel flange 208 of a frame member 204. The other one of arm portions 242, 243 of locking member 238 may be inserted in a channel 276 of an edge-adjacent panel flange 208 of an adjacent frame member 204, thereby connecting together edge-adjacent panel flanges 208 of adjacent frame members 204.

Figure 7A:
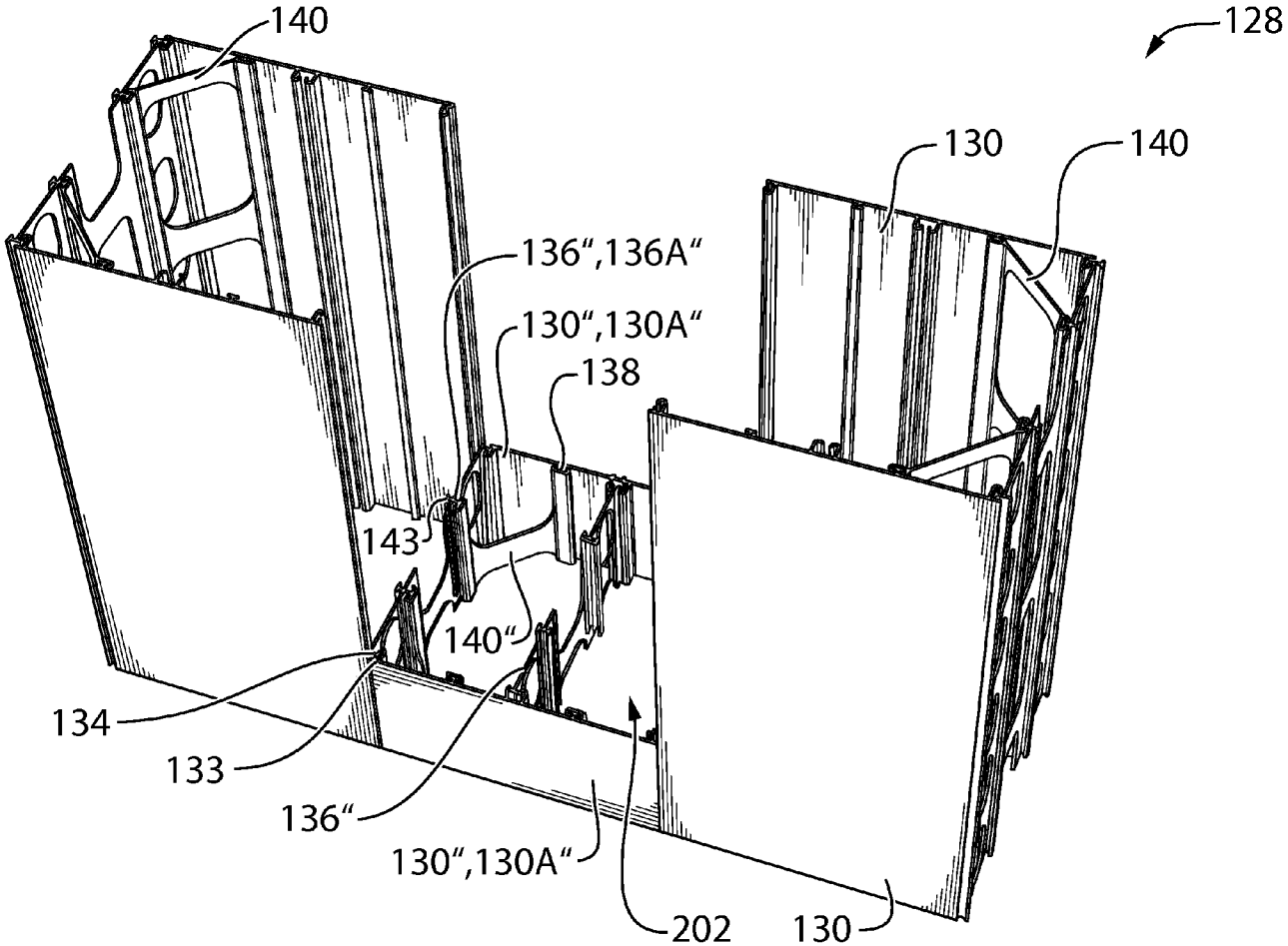
FIG. 7A is a perspective view of a form having only the lower parts of the panels and support members positioned in a cell.
Figure 7B:
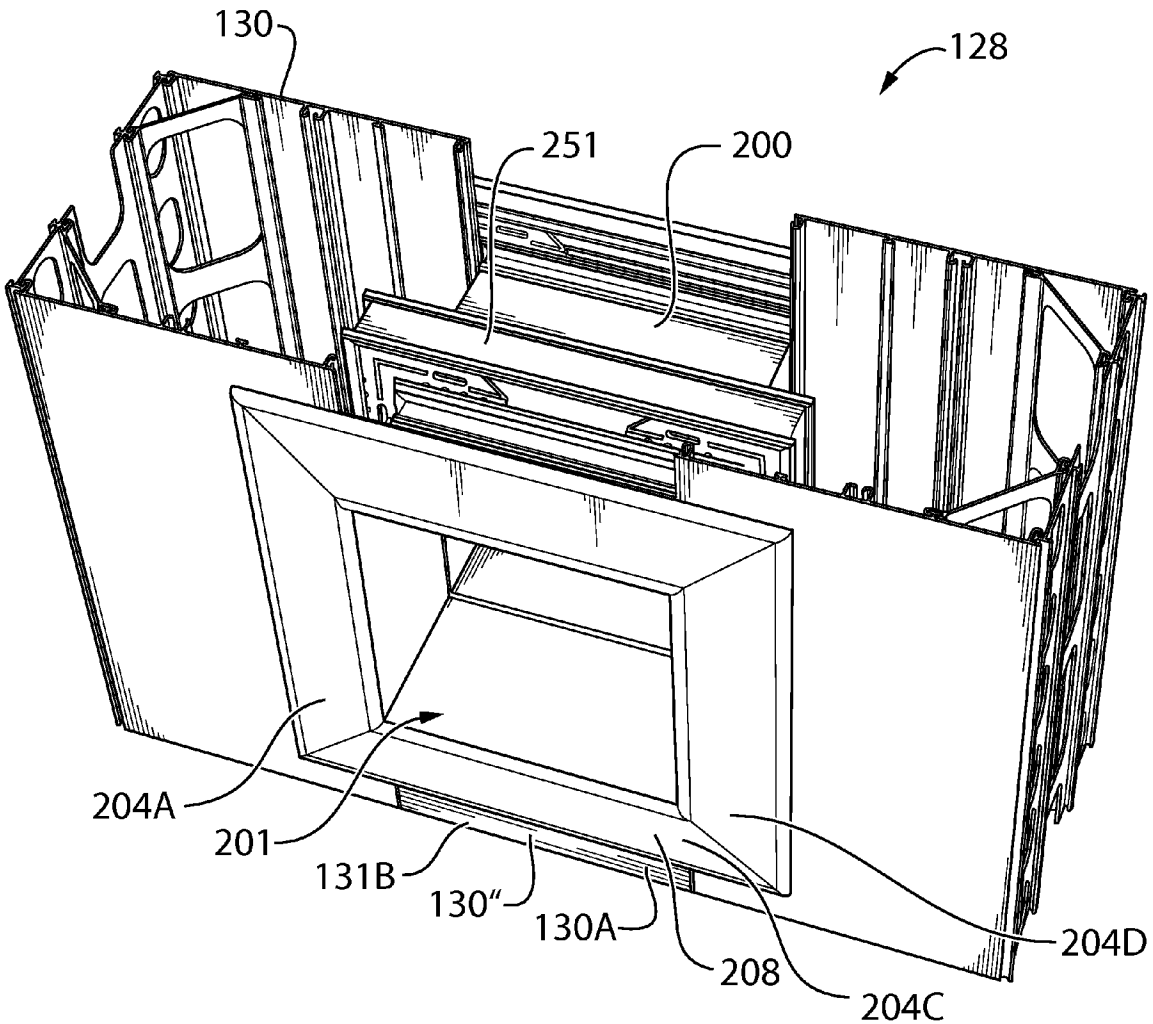
FIG. 7B is a perspective view of the FIG. 7A form with the FIG. 6A buck mounted in the cell.
Figure 7C:
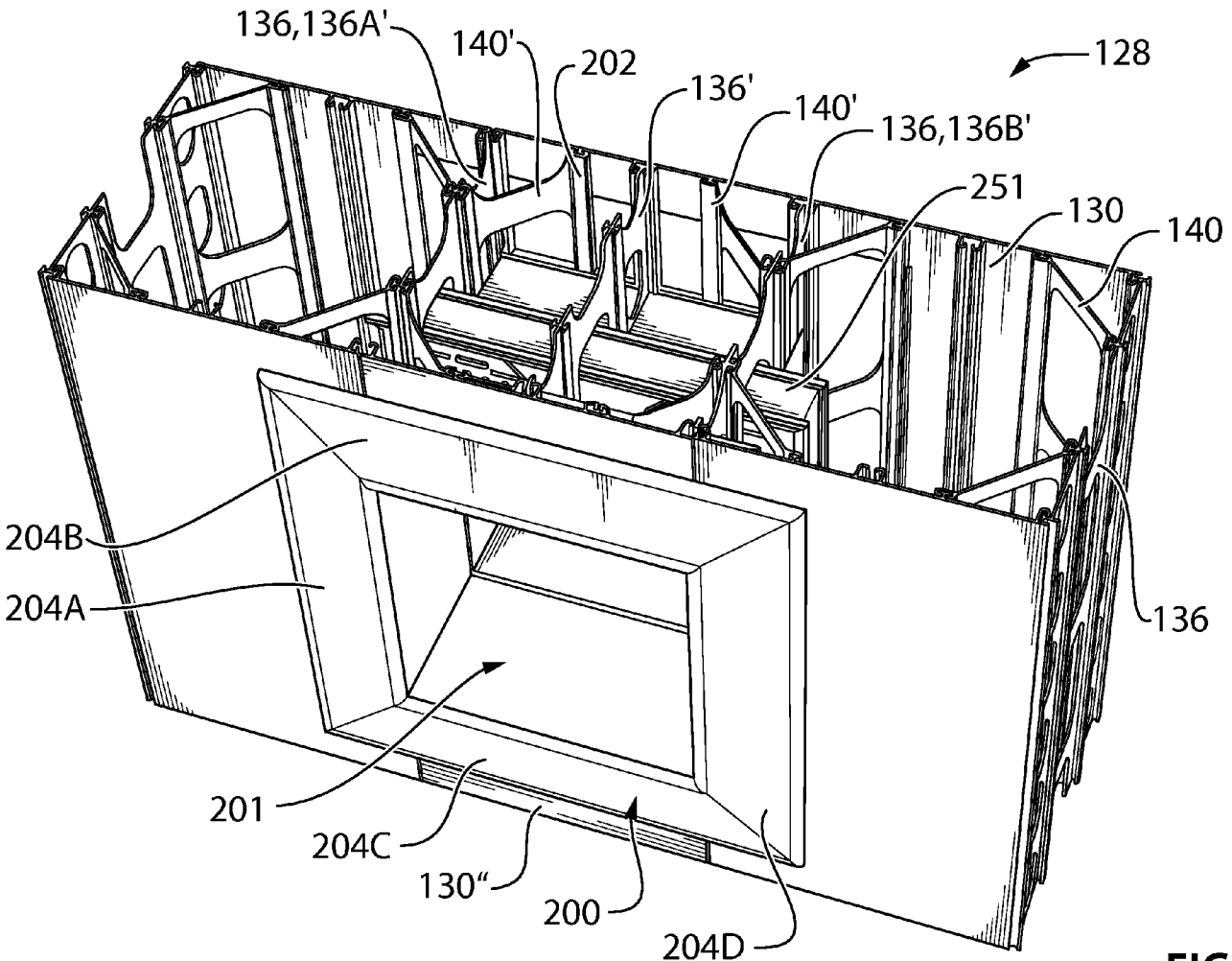
FIG. 7C is a perspective view of the FIG. 7A form with the FIG. 6A buck mounted in the cell, the form having both the lower and upper parts of the panels and support members positioned in the cell.

FIGS. 7A-7C illustrate the fabrication of form 128 and the insertion of buck 200 into cell 202 of form 128. In the illustrated embodiment of FIGS. 1 and 2, panels 130, support members 136 and tensioning members 140 within cell 202 have upper and lower parts, the upper parts of which extend downwardly to meet panel 206 of top frame member 204A and the lower parts of which extend upwardly to meet panel 206 of bottom frame member 204C. The upper parts are referenced as panels 130', support members 136', and tensioning members 140', and the lower parts (not all of which are visible in the illustrated views) are referenced as panels 130", support members 136" and tensioning members 140". As seen in FIG. 7A, prior to inserting buck 200 in cell 202, lower panels 130", lower support members 136", and lower tensioning members 140" may be assembled and positioned in cell 202 (i.e. connector components 133 on panels 130" may be slidably connected to connector components 134 on support members 136" and tensioning members 140 may be attached between connector components 143 on support members 136" and connector components 138 on panels 130").

Buck 200 may then be slid downwardly into cell 202 so that inward surfaces 213 of flanges 208 of bottom frame member 204C abut outside surfaces 131B of lower panels 130", and panel 206 of bottom frame member 204C abuts the upper edges of lower panels 130", lower support members 136" and lower tensioning members 140" (FIG. 7B). As buck 200 is placed into cell 202, flanges 208 of side frame members 204B, 204D may slide over the panels 130 adjacent (e.g. on the sides of) cell 202 and panels 206 of side frame members 204B, 204D may abut against the inside edges of the panels 130 adjacent cell 202. In the illustrated embodiment, male T-shaped connector components 280 on panels 206 of side frame members 204B, 204D (FIG. 4B) are slidably received within the receptacles of female C-shaped terminal connector components 133 on the panels 130 adjacent cell 202 (see FIG. 7B). That is, male T-shaped connector components 280 of side frame members 204B, 204D take the place of male T-shaped connector components 134 of support members 136 which would otherwise connect to female C-shaped terminal connector components 133 on the panels 130 adjacent cell 202 (see FIG. 7A). In this manner, buck 200 (via side frame members 204B, 204D) is securely coupled to form 128.

In some embodiments, optional tensioning members 140 are also used to couple buck 200 to form 128. If optional tensioning members 140 are used, male T-shaped connector components 270 on panels 206 of side frame members 204B, 204D (see FIG. 4B) may be slidably received within the receptacles of female C-shaped connector components 141B on tensioning members 140 (see FIGS. 2 and 7C). That is, male T-shaped connector components 270 of side frame members 204B, 204D take the place of male T-shaped connector components 143 of support members 136 which would otherwise connect to female C-shaped connector components 141B of tensioning members 140 (see FIG. 2). In this manner, optional tensioning members 140 may help to secure buck 200 to form 128.

Once buck 200 has been positioned in cell 202 as described above, form 128 may be completed by placing upper panels 130', upper support members 136' and optional upper tensioning members 140' into their positions above buck 200 (FIG. 7C). Upper panels 130', upper support members 136' and upper tensioning members 140' may be connected with the components of cell 202 in a similar fashion as for lower panels 130", lower support members 136" and lower tensioning members 140". When upper panels 130', upper support members 136' and upper tensioning members 140' are installed, inward surfaces 213 of flanges 208 of top frame member 204A abut outside surfaces 131B of upper panels 130', and panel 206 of top frame member 204A may abut against the lower edges of upper panels 130', upper support members 136' and upper tensioning members 140'.

If necessary or otherwise desired, transversely extending rebar and/or vertically extending rebar may be inserted in form 128, before and/or after the coupling of buck 200 to form 128. Where form 128 and buck 200 are oriented as shown in the illustrated embodiment, rebar (not shown) may extend horizontally through apertures in support members 136 and optional tensioning members 140. Vertically extending rebar can then be coupled to the horizontally extending rebar, if desired. After the optional insertion of rebar, liquid concrete is introduced into form 128. When the liquid concrete cures, the result is a structure that has two of its surfaces covered by panels 130 of form 128, and that has an opening 201 therethrough defined by buck 200. Any "extraneous" connector components within the form which are not connected with other connector components (e.g. connector components 270 and 280 on top and bottom frame members 204A, 204C, and additional connector components 230 which are not being used for connecting to fastener-receivers 226) may serve as anchors to help secure the concrete to buck 200.

Figure 6A:
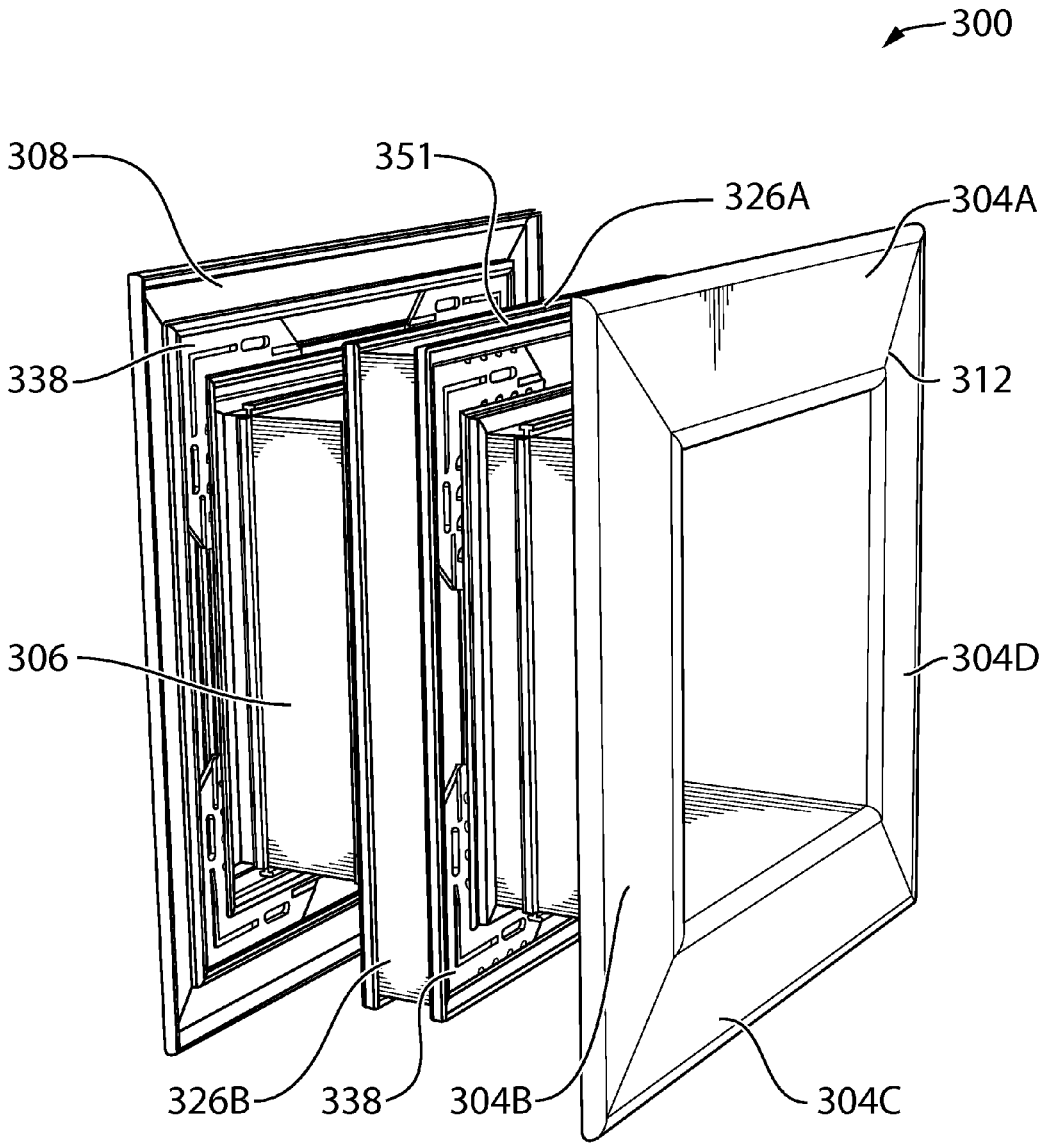
FIG. 6A is a perspective view of a buck according to another embodiment of the invention.
Figure 6B:
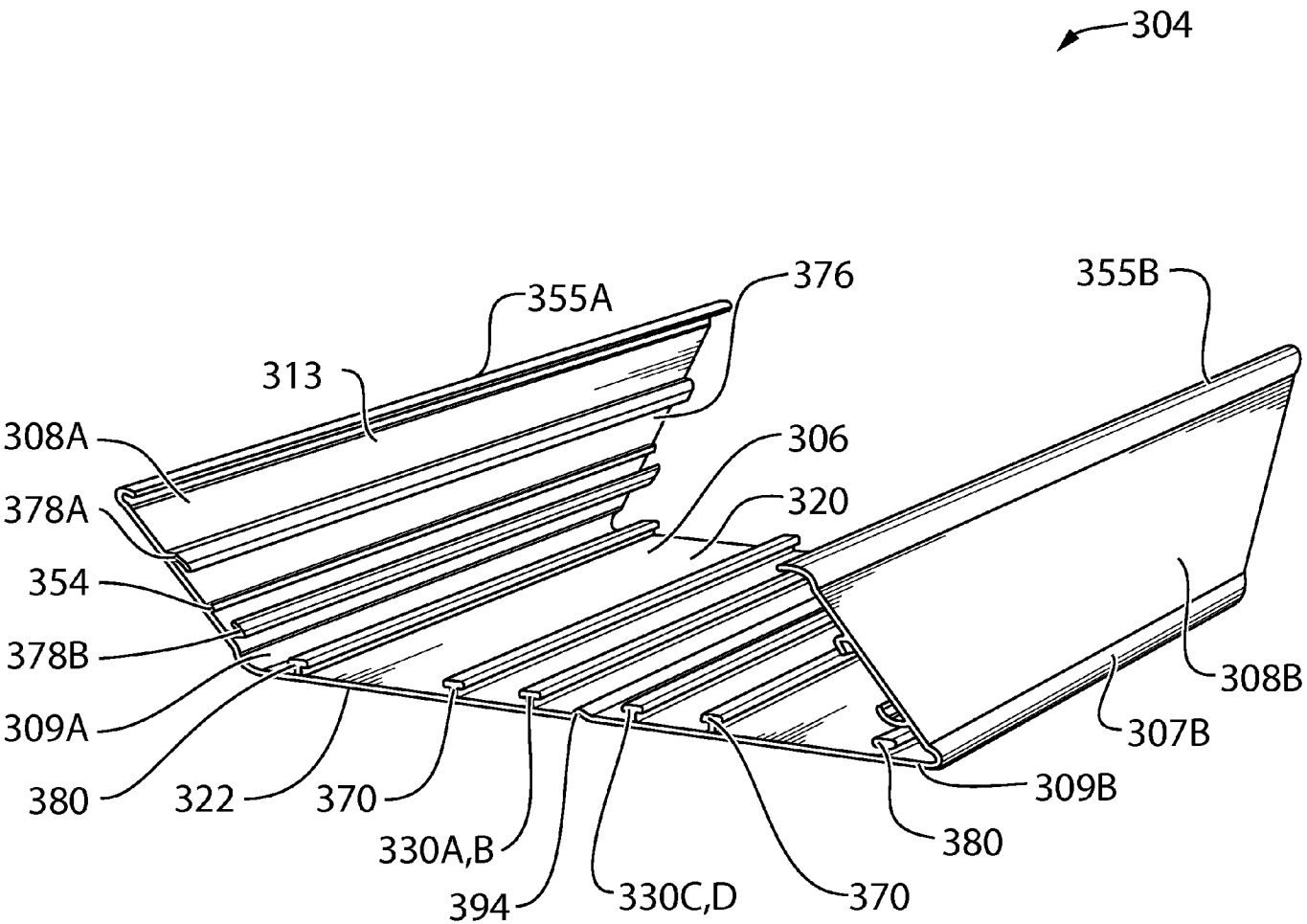
FIGS. 6B and 6C are perspective and side elevation views respectively of a frame member which may be assembled with other like frame members to create the FIG. 6A buck.

FIG. 6A illustrates a buck 300 according to another embodiment of the invention having a fastener-receiver 326 attached thereto. Buck 300 includes frame members 304 (FIGS. 6B and 6C) which, as in buck 200, may be arranged in an abutting relationship to define a substantially rectangular opening 301. Frame members 304 and fastener-receiver 326 are similar in many respects to frame members 204 and fastener-receivers 226 of buck 200, and similar reference numerals are used to refer to the similar features of frame members 304 and fastener-receivers 326, except that features of frame members 304 and fastener-receivers 326 are preceded by the leading digit "3" and features of frame members 204 and fastener-receivers 226 are preceded by the leading digit "2".

Figure 6C:
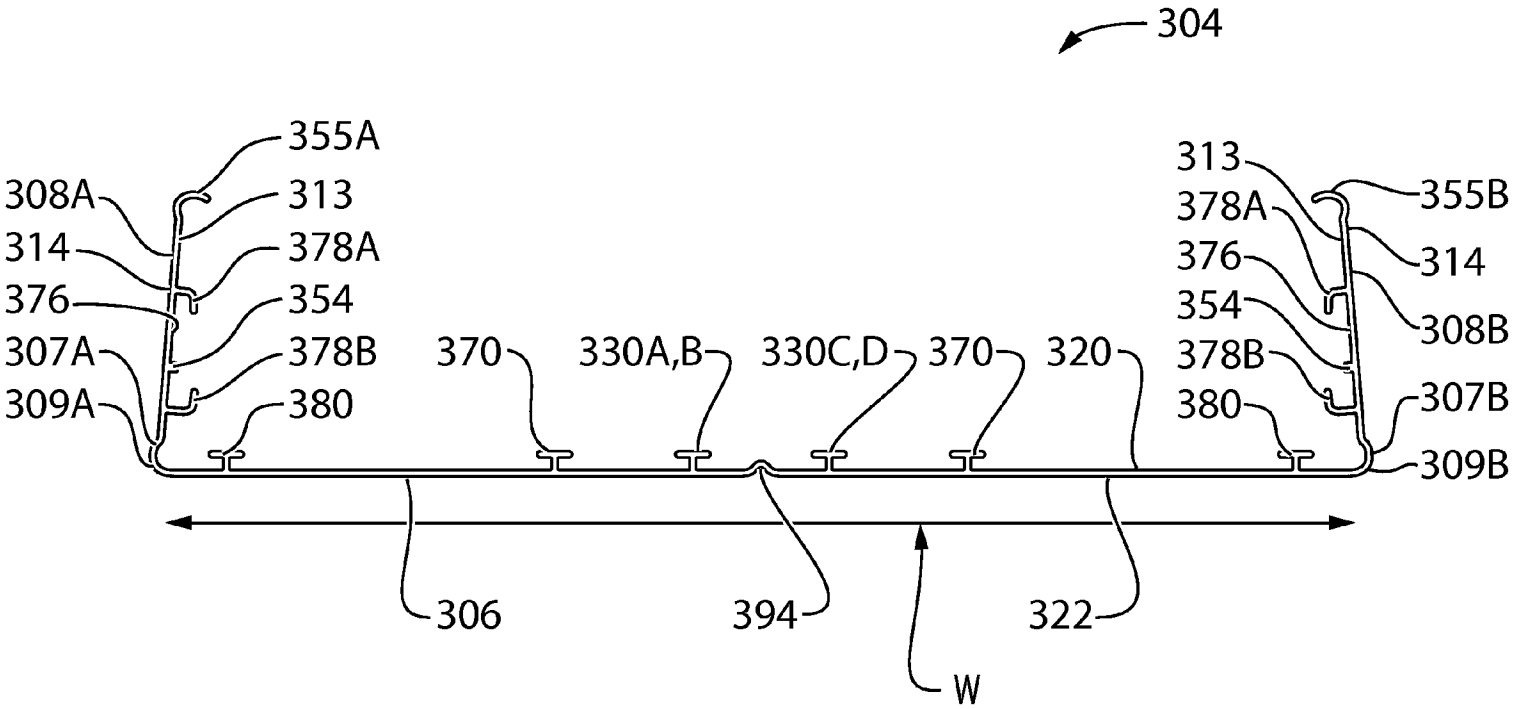

As can be seed by comparing FIGS. 4B and 6C, frame member 304 has fewer connector components 330 on first side 320 of panel 306. Frame member 304 may also have a smaller transverse dimension W relative to frame member 204, although this is not necessary. In the illustrated embodiment, frame member 304 has a set of connector components 330 (comprising connector components 330A, 330B, 330C and 330D) for slidable mounting of a fastener-receiver 326 (FIG. 6A) to form a single fastener-receiving frame 351. By contrast, frame member 204 has a sufficient number of connector components 230 for mounting two fastener-receivers 226 side-by-side to form two fastener-receiving frames 251 in parallel. Like frame member 204, however, frame member 304 has a set of connector components 370 for slidable connection to connector components 141B on optional tensioning members 140, and a set of connector components 380 for slidable connection to connector components 133 on panels 130.

Figure 8A:
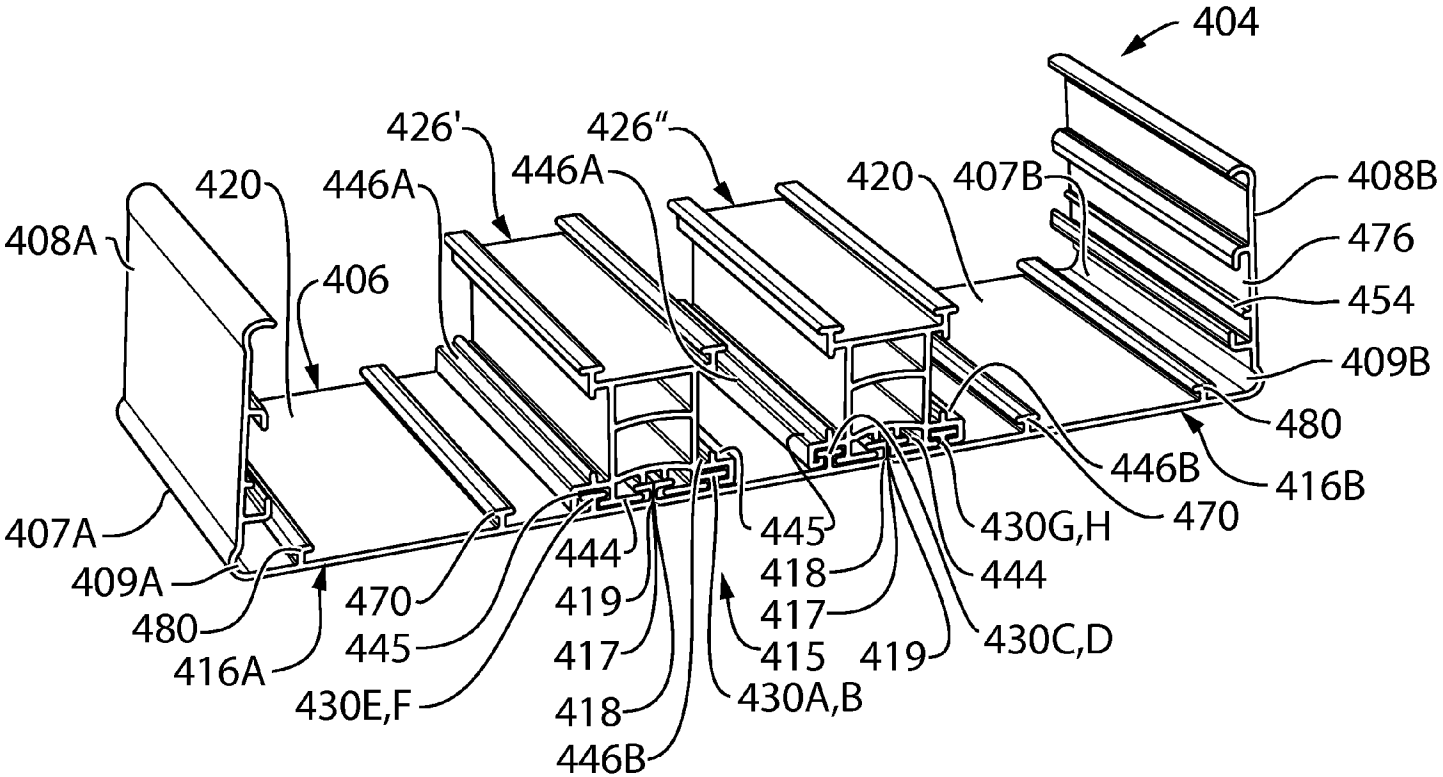
FIG. 8A is a partial perspective view of a frame member (shown with fastener-receivers connected thereto) which may be assembled with other like frame members to create a buck according to another embodiment of the invention.
Figure 8B:
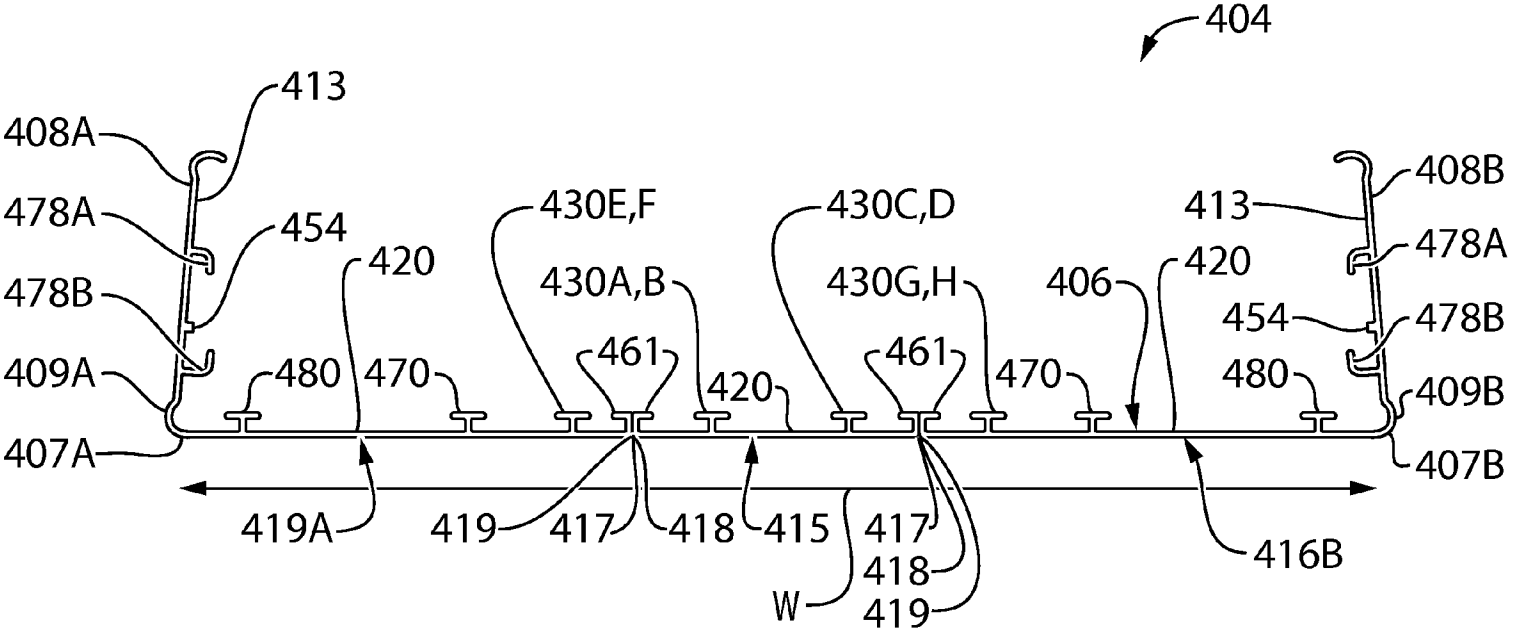
FIG. 8B is a side elevation view of the FIG. 8A frame member (shown without fastener-receivers connected thereto)

FIGS. 8A and 8B illustrate a frame member 404 according to another embodiment of the invention. FIG. 8A is a partial perspective view of frame member 404 with fastener-receivers 426 mounted thereto, and FIG. 8B is a side plan view of frame member 404 without fastener-receivers 426 mounted thereto. Frame members 404 and fastener-receivers 426 are similar in many respects to frame members 204 and fastener-receivers 226 of buck 200, and similar reference numerals are used to refer to the similar features, except that features of frame members 404 and fastener-receivers 426 are preceded by the leading digit "4" and features of frame members 204 and fastener-receivers 226 are preceded by the leading digit "2".

Frame member 404 has a similar shape to frame member 204, and includes similar features such as panel flanges 408A, 408B (collectively, panel flanges 408), connector components 430, 470 and 480. However, unlike frame member 204 which may be formed as one integral piece, frame member 404 is formed of a plurality of interconnected components. In the illustrated embodiment of FIGS. 8A and 8B, frame member 404 comprises a central component 415 and opposed L-shaped components 416A, 416B (collectively, L-shaped components 416) respectively abutting opposing edges 418 of central component 415.

Figure 8C:
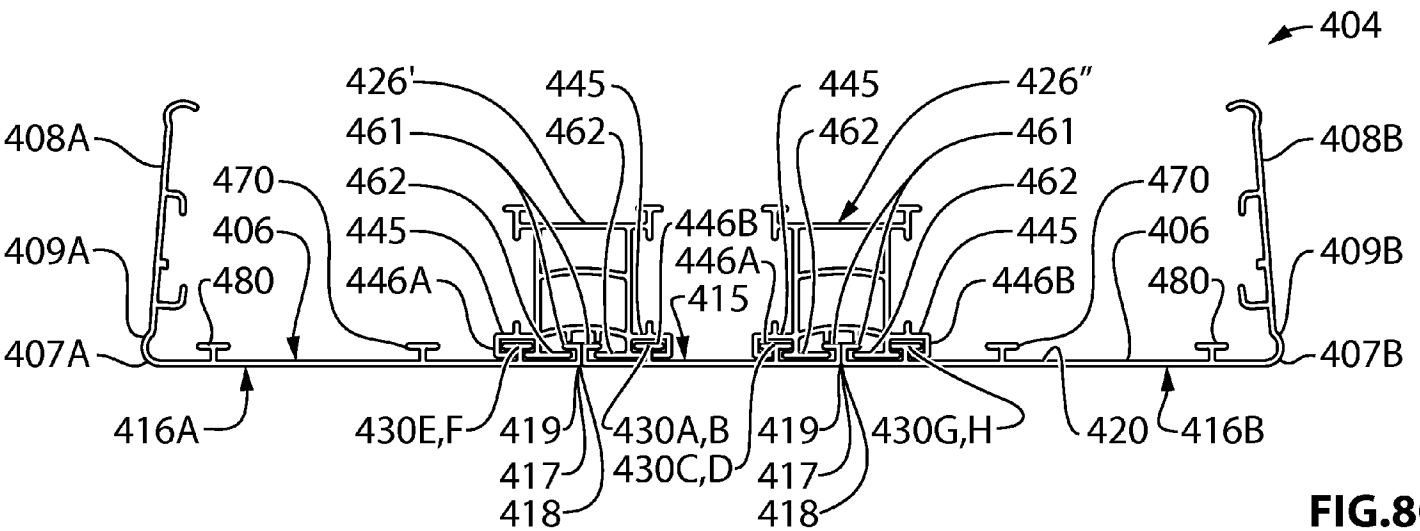
FIG. 8C is a side elevation view of the FIG. 8A frame member (shown with fastener-receivers connected thereto)

As seen in FIG. 8A, a fastener-receiver 426' may be used to connect central component 415 to L-shaped component 416A, and another fastener-receiver 426" may be used to connect central component 415 to L-shaped component 416B. Each fastener-receiver 426', 426" spans an abutment between an edge 418 of central component 415 and an adjacent edge 419 of L-shaped component 416. A male T-shaped connector component 430E-F on first side 420 of L-shaped component 416A slides into a corresponding receptacle of female C-shaped connector component 445 at edge 446A of first mounting side 444 of a fastener-receiver 426'. A male T-shaped connector component 430A-B on first side 420 of central component 415 slides into a corresponding receptacle of another female C-shaped connector component 445 at edge 446B of first mounting side 444 of fastener-receiver 426'. Similarly, a male T-shaped connector component 430C-D on first side 420 of central component 415 slides into a corresponding receptacle of female C-shaped connector component 445 at edge 446A of first mounting side 444 of fastener-receiver 426", and a male T-shaped connector component 430G-H on first side 420 of L-shaped component 416B slides into a corresponding receptacle of another female C-shaped connector component 445 at edge 446B of first mounting side 444 of fastener-receiver 426". Connector components 430A-B, 430C-D, 430E-F and 430G-H may be referred to collectively as connector components 430. When central component 415 and L-shaped components 416 are arranged in an abutting relationship, adjacent J-shaped connector components 461 along each of edges 418, 419 meet to form a T-shaped portion at connection 417 (see FIGS. 8B, 8C). Fastener-receivers 426 comprise foot portions 462 which slidably abut against first side 420 of L-shaped components 416A, 416B and central component 415 in the regions between T-shaped connector components 430 and J-shaped connector components 461.

Central component 415 and L-shaped components 416 may be connected as described above to form a frame member 404 having a multi-component panel 406 with a total transverse dimension W (FIG. 8B) that is a combination of the transverse dimensions of L-shaped components 416A, 416B and central component 415. As with frame members 204, frame member 404 may be arranged with other like frame members 404 to form a buck 400 for mounting in cell 202 of a form 128.

Figure 8D:
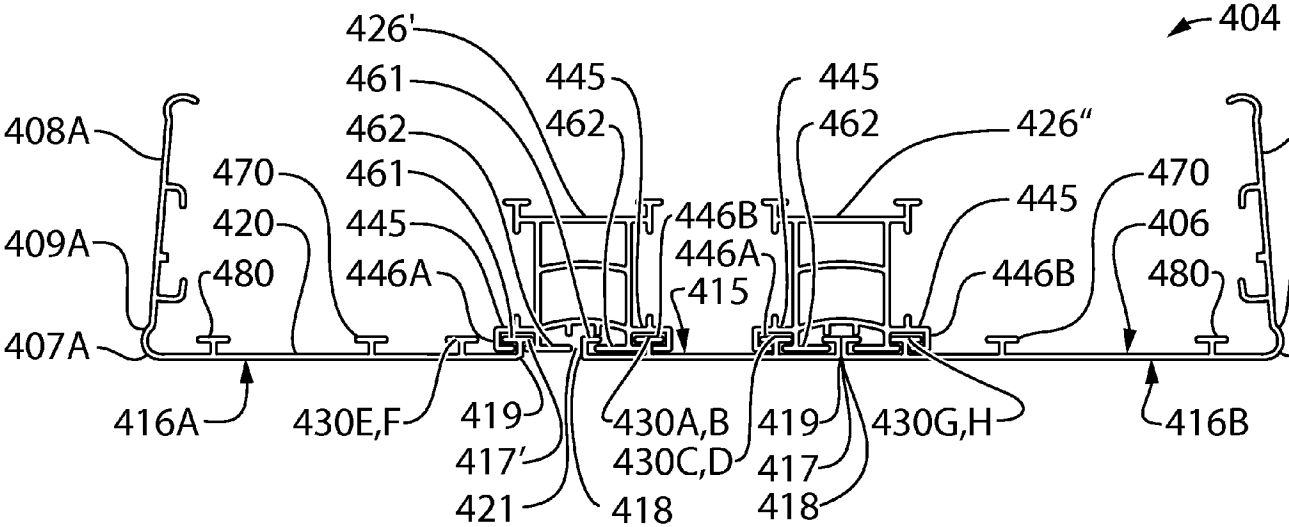
FIG. 8D is a side elevation view of the FIG. 8A frame member (shown with fastener-receivers connected thereto) arranged according to another embodiment of the invention.

The spacing between central component 415 and L-shaped components 416 may be adjusted to accommodate finer variations in the transverse dimension of form 128. For example, frame member 404 of the illustrated FIG. 8D embodiment has a slightly greater transverse dimension W than that of frame member 404 of the illustrated FIG. 8C embodiment. In the FIG. 8C embodiment, central component 415 and L-shaped components 416 are arranged so that J-shaped components 461 along each of edges 418, 419 abut one another. By contrast, in the FIG. 8D embodiment, L-shaped component 416A is spaced apart from central component 415 in the transverse dimension, leaving a gap 421 between J-shaped connector component 461 at edge 419 of L-shaped component 416A and J-shaped connector component 461 at adjacent edge 418 of central component 415. To connect L-shaped component 416A with central component 415, J-shaped connector component 461 at edge 419 of L-shaped component 416A slides into female C-shaped connector components 445 at edge 446A of first mounting side 444 of fastener-receiver 426'. Male T-shaped connector component 430A-B on first side 420 of central component 415 slides into a corresponding receptacle of female C-shaped connector component 445 at edge 446B of first mounting side 444 of fastener-receiver 426'. Male T-shaped connector component 430E-F remains unconnected. Fastener-receiver 426' has a foot portion 462 proximate to edge 446A which is positioned in the gap 421 between J-shaped components 461 of L-shaped component 416 and central component 415.

If desired, the spacing between central component 415 and L-shaped component 416B may be adjusted in a similar fashion as described above for central component 415 and L-shaped component 416A. If desired, central component 415 may additionally or alternatively be offset in a similar manner. For example, J-shaped connector component 461 on edge 418 of central component 415 may be connected to female C-shaped connector component 445 at edge 446B of first mounting side 444 of fastener-receiver 426'.

An advantage provided by the FIG. 8 embodiment is increased flexibility in adapting frame member 404 for use with forms 128 of various transverse dimensions. For example, central component 415 and/or L-shaped components 416 may be formed or cut to have a certain transverse dimension such that the overall transverse dimension W of the assembled frame member 404 corresponds with a desired transverse distance between opposed panels 130A, 130B of cell 202 of form 128. In other embodiments, two or more central components 415 may be arranged in an edge to edge relationship between L-shaped components 416 to form a frame member 404 having an increased transverse dimension W. In still other embodiments, the spacing between central component 415 and L-shaped components 416 may be adjusted, such as in the manner described above with reference to FIG. 8D, to adjust the transverse dimension W of frame member 404 in smaller increments. Frame member 404 may thereby be adapted for use with a form 128 of any suitable transverse dimension. In some embodiments, frame member 404 may be adjusted in the field to accommodate a form 128 having a transverse dimension between 4" and 24", for example. Moreover, the assembly of frame member 404 from central component 415 and L-shaped components 416 allows for more compact nesting or stacking of the components of buck 400, which facilitates packaging and delivery of the components of buck 400.

It is not necessary that fastener-receivers 426 be used to connect central component 415 with L-shaped components 416 as shown in FIG. 8A. Other suitable means of connecting the components may be used. For example, clips or other fastening devices may be used to connect central component 415 with L-shaped components 416. Such clips or other fastening devices may (but need not) have a profile similar to the lower (in the illustrated views) profile of fastener receivers 426—i.e. incorporating features such as connector components 445 and foot portions 462. In other embodiments, central components 415 and L-shaped components 416 may be provided or formed with interconnecting components at adjacent edges 418, 419—i.e. such that central components 415 and L-shaped components 416 connect directly to one another without the assistance of a third component. It is also not necessary that L-shaped components 416 be connected to a central component 415 to form frame member 404. In some embodiments, central component 415 may be omitted, and L-shaped components 416 may be connected together to form frame member 404.

Figure 9A:
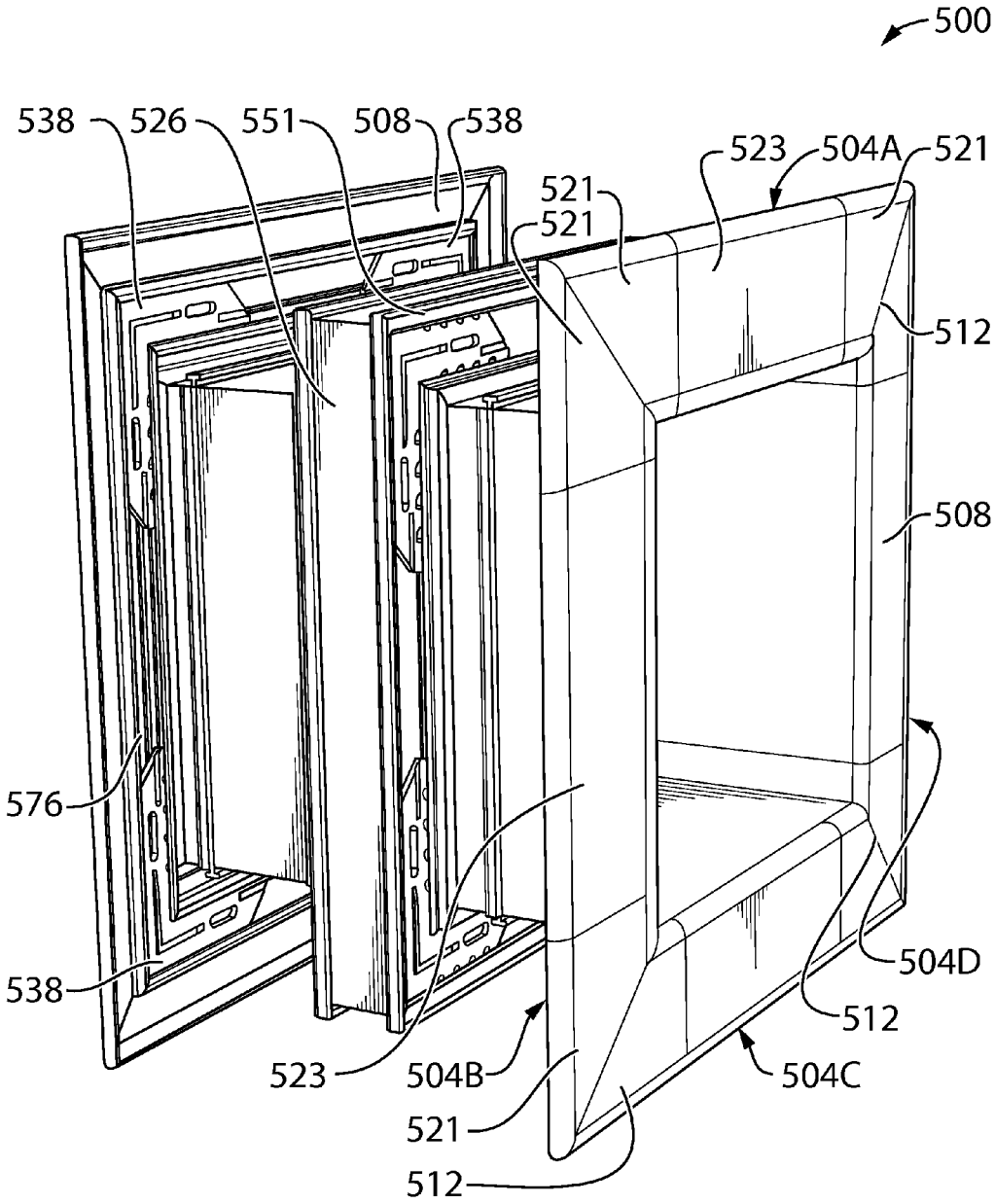
FIG. 9A is a perspective view of a buck according to another embodiment of the invention.
Figure 9B:
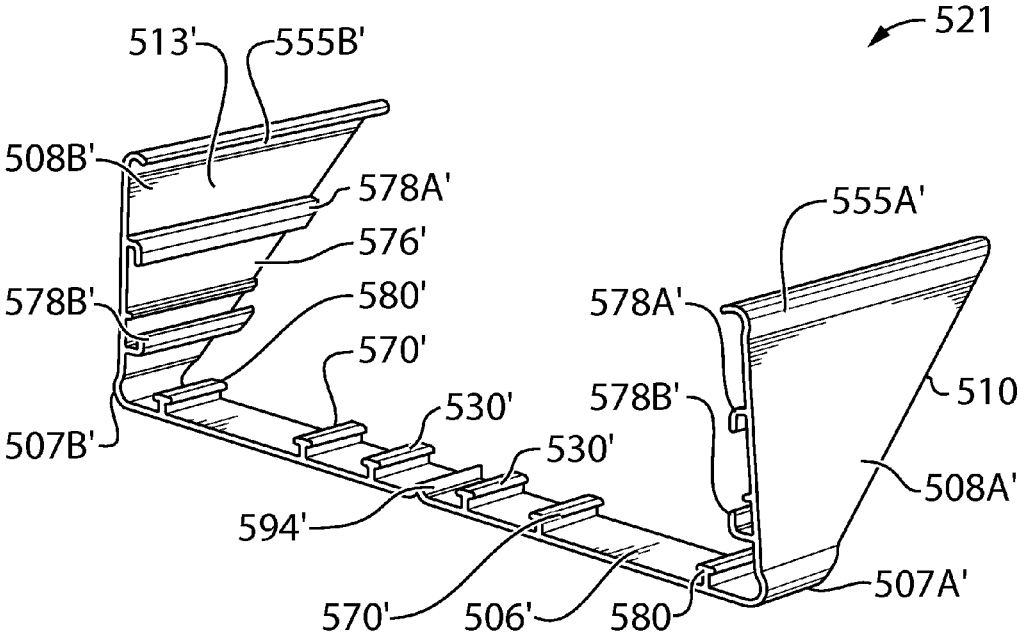
FIG. 9B is a perspective view of a corner frame component of the FIG. 9A buck.
Figure 9C:
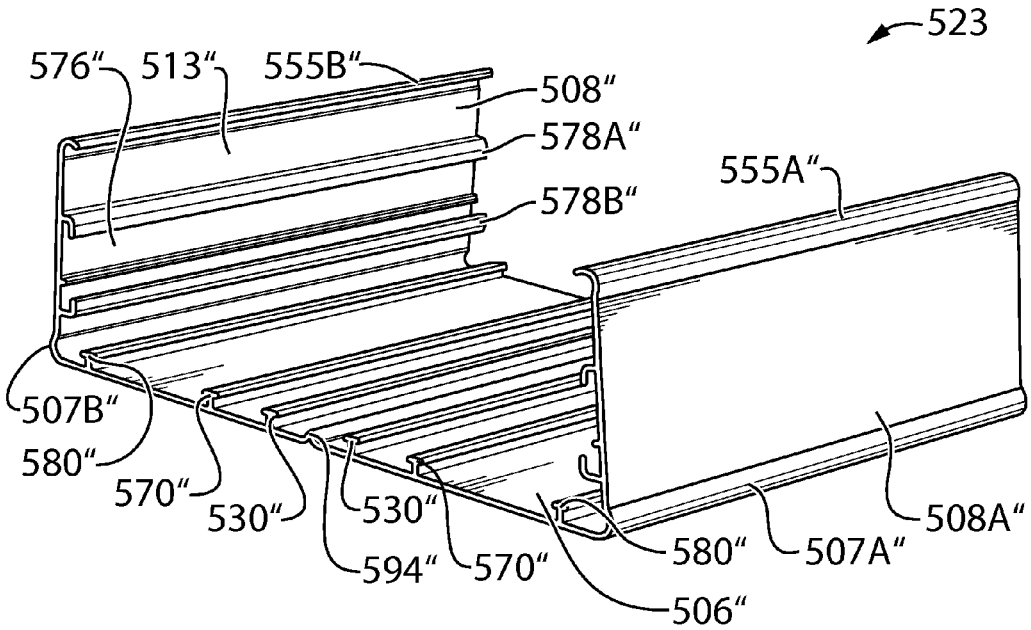
FIG. 9C is a perspective view of a central frame component of the FIG. 9A buck.

FIGS. 9A-9C illustrate a buck 500 according to another embodiment of the invention. Buck 500 is similar in many respects to buck 200, and similar reference numerals are used to refer to the similar features, except that features and components of buck 500 are preceded by the leading digit "5" and features and components of buck 200 are preceded by the leading digit "2". Frame members 504 of buck 500 have a similar shape to frame members 204 of buck 200, and include similar features such as panel flanges 508A, 508B (collectively, panel flanges 508), and connector components 530. Also, frame members 504 may include connector components 570, 580, ridges 594, drainage channels 509, and other features similar to those of frame members 204. As with frame members 204, frame members 504 may be arranged to form a buck 500 for mounting in cell 202 of a form 128. However, unlike frame members 204 which may be formed as one integral piece, each frame member 504 is formed of a plurality of components which are connected in an edge to edge relationship. In the illustrated embodiment, each frame member 504 comprises a central frame component 523 (FIG. 9C) and a pair of opposed corner frame components 521 (FIG. 9B) arranged at opposing edges of central frame component 523. Each of corner frame components 521 and central frame component 523 has a transverse dimension W sized to span a transverse distance between opposed panels 130A, 130B of form 128.

As seen in FIG. 9B, each corner frame component 521 comprises a panel 506' and a pair of panel flanges 508A', 508B' (collectively, panel flanges 508') extending from opposed longitudinally extending edges 507A', 507B' (collectively, edges 507') of panel 506'. Each flange 508' may be fabricated with, or cut to provide, a pair of mitered end edges 510, each of which abuts against, and forms a miter joint 512 with, a corresponding mitered end edge 510 of flange 508' of an adjacent corner frame component 521 of an adjacent frame member 504.

As best seen in FIG. 9C, central frame component 523 comprises a panel 506" and a pair of panel flanges 508A", 508B" (collectively, panel flanges 508") extending from opposed longitudinally extending edges 507A", 507B" (collectively, edges 507") of panel 506". When central frame component 523 is arranged between a pair of opposed corner frame components 521 as shown in FIG. 9A, panel 506" and panel flanges 508" of central frame component 523 align with, and provide a longitudinal extension of, corresponding panel 506' and panel flanges 508' of opposed corner frame components 521.

Central frame component 523 and a pair of opposed corner frame components 521 collectively form each of frame members 504. Panels 506' and 506" collectively form panel 506 of frame member 504. Panel flanges 508A', 508B' and 508A", 508B" collectively form panel flanges 508A, 508B, respectively, of frame member 504.

Corner frame components 521 and central frame component 523 may be connected together by one or more fastener-receivers 526 and locking members 538. Fastener-receivers 526 are connected to connector components 530' on corner frame components 521 and connector components 530" on central frame component 523. When central frame component 523 is arranged between a pair of opposed corner frame components 521 as shown in FIG. 9A, connector components 530" on central frame component 523 are aligned with corresponding connector components 530' on opposed corner frame components 521. Connector components 530' and 530" collectively form connector components 530 on frame member 504. Connector components 530 on frame member 504 are complementary to connector components 545 on fastener-receivers 526. Locking members 538 may also connect adjacent fastener-receivers 526 to one another in a manner similar to that described above for locking members 238 and fastener-receivers 226.

As shown in FIGS. 9B and 9C, corner frame components 521 and central frame component 523 may have additional connector components. These may include:

- connector components 570' on corner frame components 521 and connector components 570" on central frame component 523 (collectively forming connector components 570 on frame member 504) for connecting to complementary connector components 141B on optional tensioning members 140; and
- connector components 580' on corner frame components 521 and connector components 580" on central frame component 523 (collectively forming connector components 580 on frame member 504) for connecting to complementary connector components 133 on panels 130.

Corner frame components 521 and central frame component 523 may also be connected together by locking mechanisms provided on panel flanges 508', 508". Such locking mechanisms may be similar to those described for buck 200. A channel 576', 576" may be provided on panel flanges 508', 508", respectively, for receiving one leg of a locking member 538. On panel flanges 508', channel 576' is defined by side 513' and locking flanges 578A', 578B' (collectively, locking flanges 578') which project transversely from side 513' and toward one another. Similarly, on panel flanges 508", channel 576" is defined by side 513" and locking flanges 578A", 578B" (collectively, locking flanges 578") which project transversely from side 513" and toward one another. When central frame component 523 is arranged between a pair of opposed corner frame components 521 as shown in FIG. 9A, channel 576" on central frame component 523 is aligned with each channel 576' on opposed corner frame components 521. Channels 576' and 576" collectively form channel 576 on frame member 504. The legs of L-shaped locking member 538 may be inserted in channels 576 of adjacent panel flanges 508 of adjacent frame members 504 (FIG. 9A) to connect together edge-adjacent corner frame components 521 and central frame components 523 at each corner of buck 500.

An advantage provided by the FIG. 9 embodiment is increased flexibility in adapting frame member 504 for use to define openings 201 of various dimensions. For example, central frame component 523 and/or corner frame components 521 may be formed or cut to have a certain longitudinal dimension such that the overall longitudinal dimension L of frame member 504 is of the desired dimension for the corresponding side of opening 201. Cutting central frame component 523 at right angles may be easier than cutting a miter joint. Corner frame components 521 may be provided as standard components which are prefabricated with their miter surfaces and need not be cut. Moreover, the assembly of frame member 504 from its various components as described herein allows for more compact nesting or stacking of the components of buck 500, which facilitates packaging and delivery of the components of buck 500.

Figure 10A:
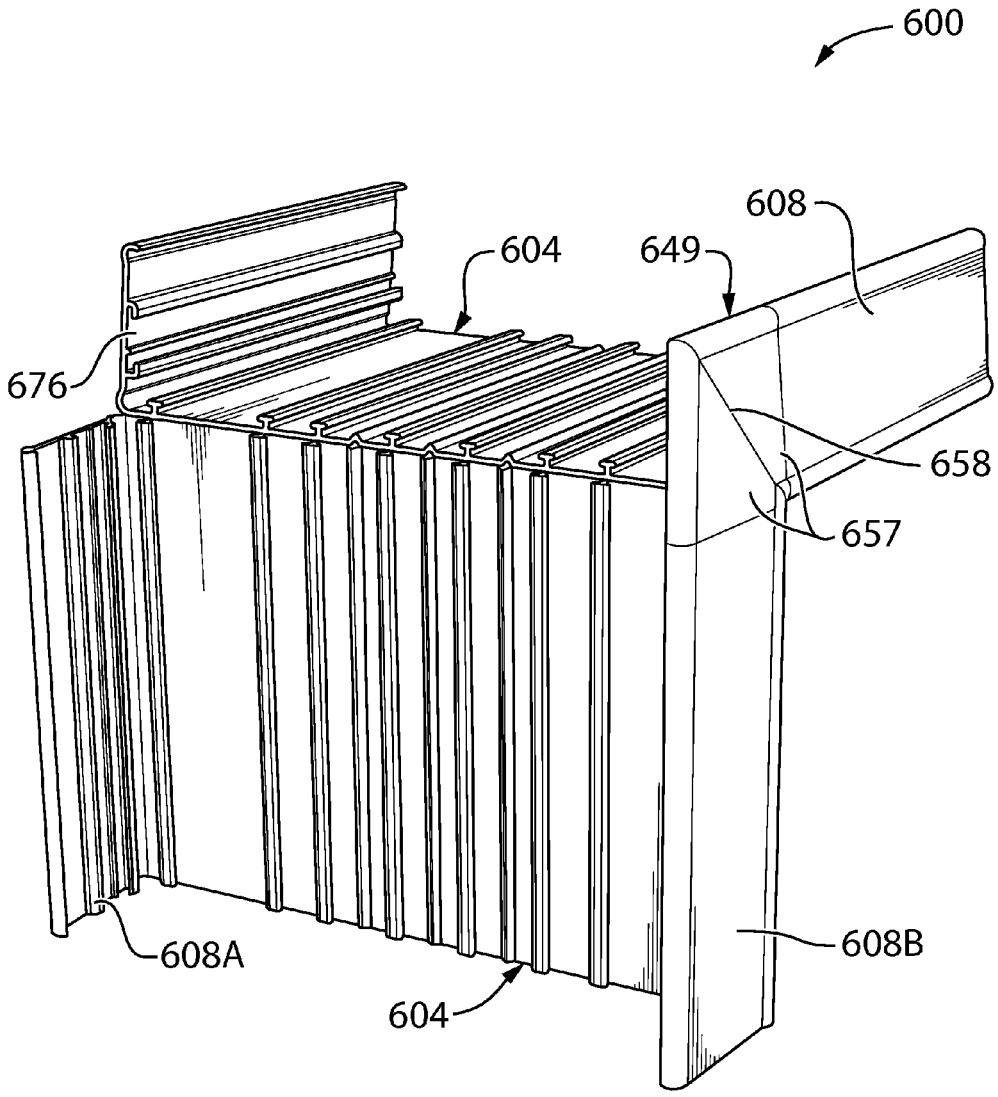
FIG. 10A is a partial perspective view of a buck according to another embodiment of the invention.

FIG. 10A is a partial perspective view of a buck 600 according to another embodiment of the invention. Buck 600 is similar in many respects to buck 200, and similar reference numerals are used to refer to the similar features, except that features and components of buck 600 are preceded by the leading digit "6" and features and components of buck 200 are preceded by the leading digit "2". Like frame member 204 of buck 200, frame member 604 of buck 600 has a rectangular panel 606 and a pair of panel flanges 608A, 608B (collectively, panel flanges 608) extending from opposed longitudinally extending edges 607A, 607B (collectively, edges 607) of panel 606. However, unlike panel flanges 208 of frame member 204 which have mitered end edges 210, each panel flange 608 is fabricated to be generally rectangular in shape. A rectangular corner piece 649 (FIG. 10B) is arranged at each corner of buck 600 between adjacent frame members 604. Edges 656 of corner pieces 649 (FIG. 10B) abut against edges 610 of adjacent panel flanges 608 (FIG. 10A), so that corner pieces 649 and flanges 608 collectively form frames 611 for abutting against outer surfaces 131B of panels 130A, 130B of form 128.

Figure 10B:
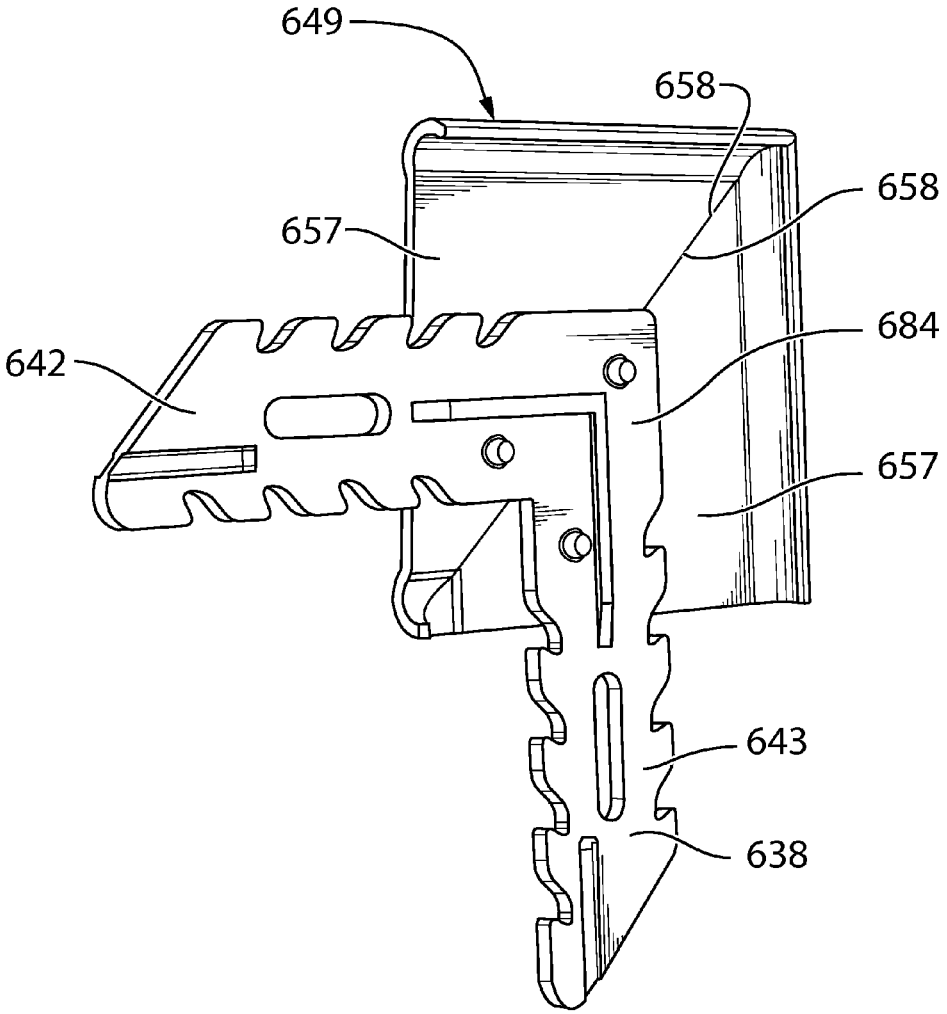
FIG. 10B is a perspective view of a corner piece shown with a locking member attached thereto, which may be used in the FIG. 10A buck.

A locking member 638 (having similar features to locking member 238) may be used to connect corner piece 649 to adjacent panel flanges 608. Locking member 638 may be fastened to a corner piece 649 by bolts, screws or other means (FIG. 10B). In other embodiments, locking members 238 may be integrally formed with corner pieces 649. Arm portions 642, 643 of locking member 638, which extend past edges 656 of corner pieces 649, may be inserted into respective channels 676 of adjacent panel flanges 608. Frame members 604 and corner pieces 649 may thereby be assembled to form a buck 600 as shown in FIG. 10A.

Corner piece 649 may be injection molded as a single piece, or assembled from separate components. For example corner piece 649 may be fabricated as a single rectangularly shaped component. In the illustrated embodiment of FIGS. 10A and 10B, however, corner piece 649 comprises two triangular members 657, arranged in abutting relationship. Each triangular member 657 has a mitered edge 658 for abutment against a corresponding mitered edge 658 of an adjacent triangular member 657. A pair of abutting triangular members 657 may be connected together by way of locking member 638 which is fastened to both triangular members 657.

In other embodiments, triangular members 657 may be provided with channels 676' which are similar to channels 676 of panel flanges 608. Locking member 638 may be fastened to triangular members 657 by insertion of arm portions 642, 643 of locking member 638 into respective channels 676' of adjacent triangular members 657.

Figure 11A:
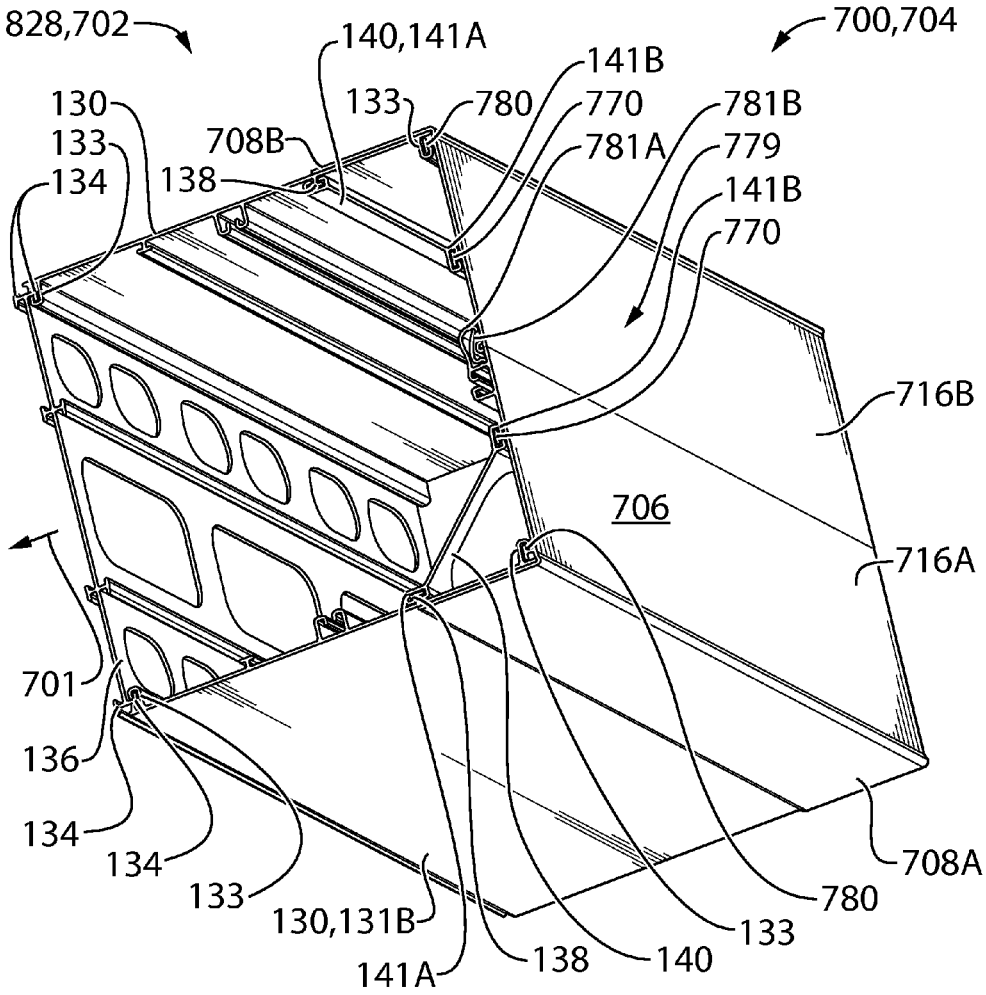
FIGS. 11A and 11B are respectively isometric and top plan views of a form edge system used to provide an edge of a modular stay-in-place form according to an example embodiment.
Figure 11B:
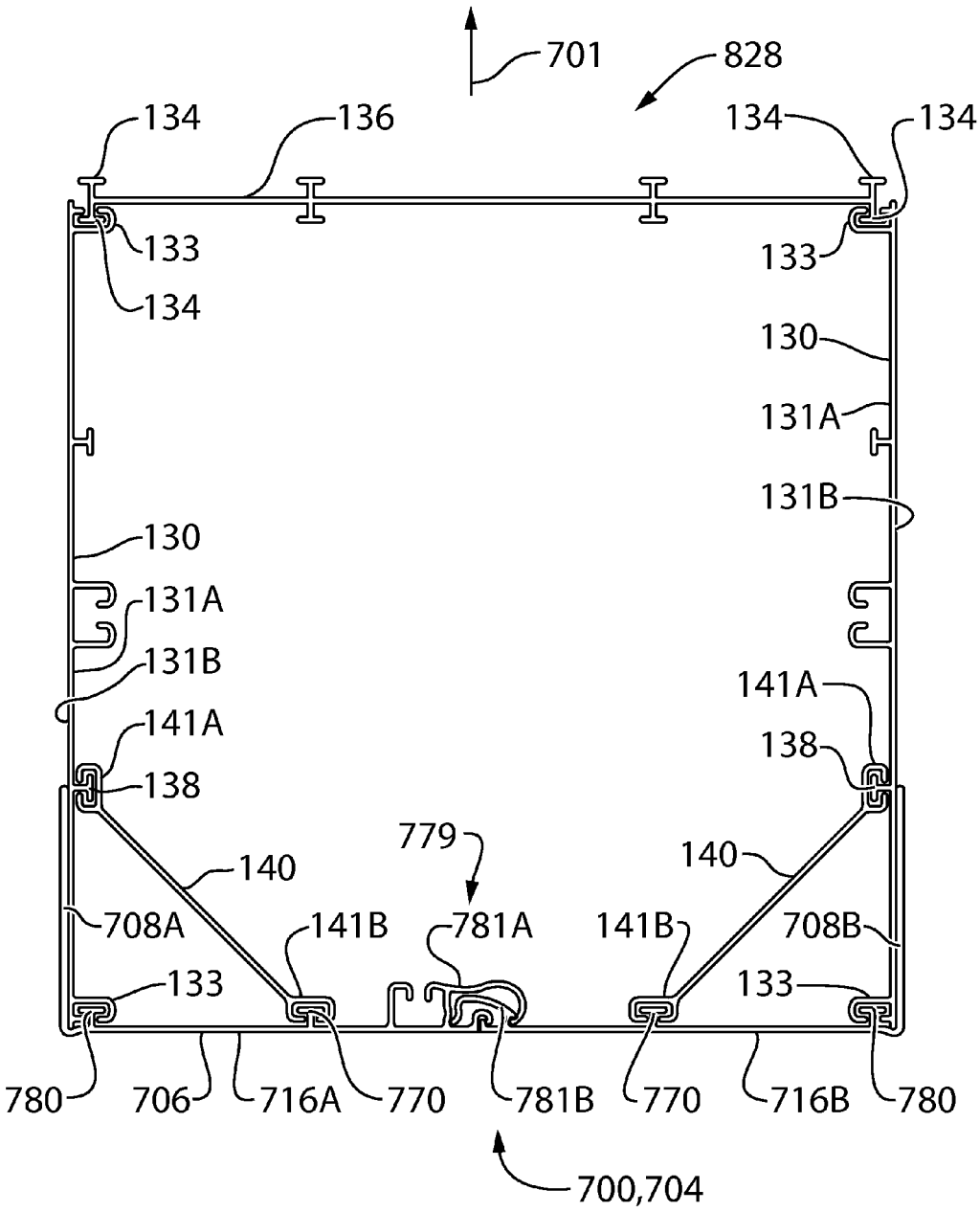

Another aspect of the invention provides form edge systems for modular stay-in-place forms which may be used to fabricate corresponding corners, extremities or other edges of building structures or other structures. The above-described embodiments of bucks represent one particular non-limiting type of form edge system for fabricating structural edges (e.g. the edges that define a structural opening such as a building opening for windows or the like). FIGS. 11A and 11B show a form edge system 700 according to another embodiment of the invention. Form edge system 700 may be a part of, and used to provide, an edge to form 828. Form edge system 700 may provide the part of form 828 used to fabricate the edge of a structure.

Form 828 of FIGS. 11A and 11B is similar in many respects to form 128 described above and includes panels 130 and support members 136 which are substantially similar to panels 130 and support members 136 described above. To more clearly focus on depicting and describing form edge system 700, FIGS. 11A and 11B show only a single cell 702 on an edge of form 828 (i.e. an edge cell 702), it being appreciated that form 828 continues in direction 701 with additional panels 130 and support members 136 connected as described above. In general, form 828 may be used to fabricate any structure. Form 828 differs slightly from form 128 illustrated above in that form 828 of the illustrated embodiment only uses optional tensioning members 140 as a part of form edge system 700. It will be appreciated, however, that if extra strength was desired, form 828 could incorporate optional tensioning members 140 connected between panels 130 and support members 136 as described above. In other respects, form 828 is similar to form 128.

Form edge system 700 comprises a multi-component frame member 704 similar in many respects to multi-component frame member 404 of buck 400 (FIGS. 8A, 8B). Similar reference numerals are used to refer to similar features of frame members 704, 404, except that features of frame member 704 are preceded by the leading digit "7" and features of frame member 404 are preceded by the leading digit "4". Frame member 704 comprises a pair of opposed L-shaped components 716A, 716B (collectively, L-shaped components 716) which comprise corresponding panel flanges 708A, 708B. Panel flanges 708A, 708B of frame member 704 are substantially similar to panel flanges 408A, 408B of frame member 404 and extend away from the edges of panel 706 to abut against the outward surfaces 131B of panels 130.

Frame member 704 also comprises: connector components 770 (which are substantially similar to connector components 470 of frame member 404) for connecting to complementary connector components 141B on optional tensioning members 140; and connector components 780 (which are substantially similar to connector components 480 of frame member 404) for connecting to complementary terminal connector components 133 on panels 130 of edge cell 702. Frame member 704 of the illustrated embodiment does not include connector components analogous to connector components 430 of frame member 404, since frame member 704 of the illustrated embodiment does not include fastener-receivers 426. In other embodiments, however, frame member 704 could be provided with connector components similar to connector components 430 for connecting to corresponding fastener-receivers. Such fastener-receivers could be similar to any of those discussed above.

Frame member 704 also differs from frame member 404 in that frame member 704 does not include a central component that is analogous to central component 415 and in that frame member 704 does not make use of fastener-receivers 426 to effect connections between its multiple components. Instead, L-shaped components 716 connect directly to one another at connections 779 between a pair of complementary connector components 781A, 781B to provide frame member 704 with panel 706. In the illustrated embodiment, L-shaped component 716A comprises a first, generally female connector component 781A and L-shaped component 716B comprises a second, generally male connector component 781B which is complementary to connector component 781A.

Connector components 781A, 781B may be similar to the connector components described in Patent Cooperation Treaty application No. PCT/CA2008/001951 (published under WO2009/059410) entitled PIVOTALLY ACTIVATED CONNECTOR COMPONENTS FOR FORM-WORK SYSTEMS AND METHODS FOR USE OF SAME which is hereby incorporated herein by reference. More particularly, connection 779 between connector components 781A, 781B may be effected by forming a loose fit connection between connector components 781A, 781B, pivoting connector components 781A, 781B and/or L-shaped components 716A, 716B relative to one another to thereby cause deformation of one or both of connector components 781A, 781B and allowing restorative deformation forces to lock connector components 781A, 781B to one another to form connection 779. In other embodiments, connector components 781A, 781B may comprise other forms of complementary connector components. In still other embodiments, fastener-receivers similar to fastener-receivers 426 may be used to couple L-shaped components 716A, 716B to one another.

In other respects, frame member 704 may incorporate features of frame members 404 and/or frame members 204 described above.

In operation, form edge system 700 may be used to define the edge of form 828. First, the other components of form 828 (e.g. panels 130, support members 136 and optional tensioning members 140) may be assembled as described above—e.g. panels 130 may be connected to one another in edge-adjacent relationship using support members 136 which extend transversely between panels 130 and optional tensioning members 140 (not shown in FIGS. 11A, 11B) may be coupled between support members 136 and panels 130. If desired, rebar can be inserted into form 828 as described above. Frame member 704 is also assembled by coupling L-shaped components 716 to one another. Frame member 704 may then be coupled to the edge of form 828 by sliding panel flanges 708A, 708B over the outward surfaces 131B of panels 130 of edge cell 702 and coupling connector components 780 of frame member 704 with corresponding terminal connector components 133 on the edges of panels 130 of edge cell 702. In the illustrated embodiment, connector components 780 are male T-shaped connector components which are slidably received in C-shaped female terminal connector components 133 of panels 130, although this is not necessary and any suitable complementary connector components may be used.

Optional tensioning members 140 may then be connected between panels 130 and frame member 704 to complete the connection of form edge system 700 to the rest of form 828. More particularly, connector components 770 of frame member 704 may be connected to complementary connector components 141B on one end of tensioning members 140 and connector components 138 of panels 130 of edge cell 702 may be connected to complementary connector components 141A on the other end of tensioning members 140. In the illustrated embodiment, connector components 770, 138 are T-shaped male connector component which slidably engage female, C-shaped connector components 141A, 141B of tensioning members 140, although this is not necessary and any suitable complementary connector components may be used.

Once form edge system 700 has been coupled to the rest of form 828 as described above, liquid concrete is introduced to form 828. When the liquid concrete cures, the result is a structure having two of its surfaces covered by panels 130 and an edge covered by frame member 704. Any "extraneous" connector components within form 828 that are not coupled to other connector components may serve as anchors to help secure the concrete to form 828.

Figure 12A:
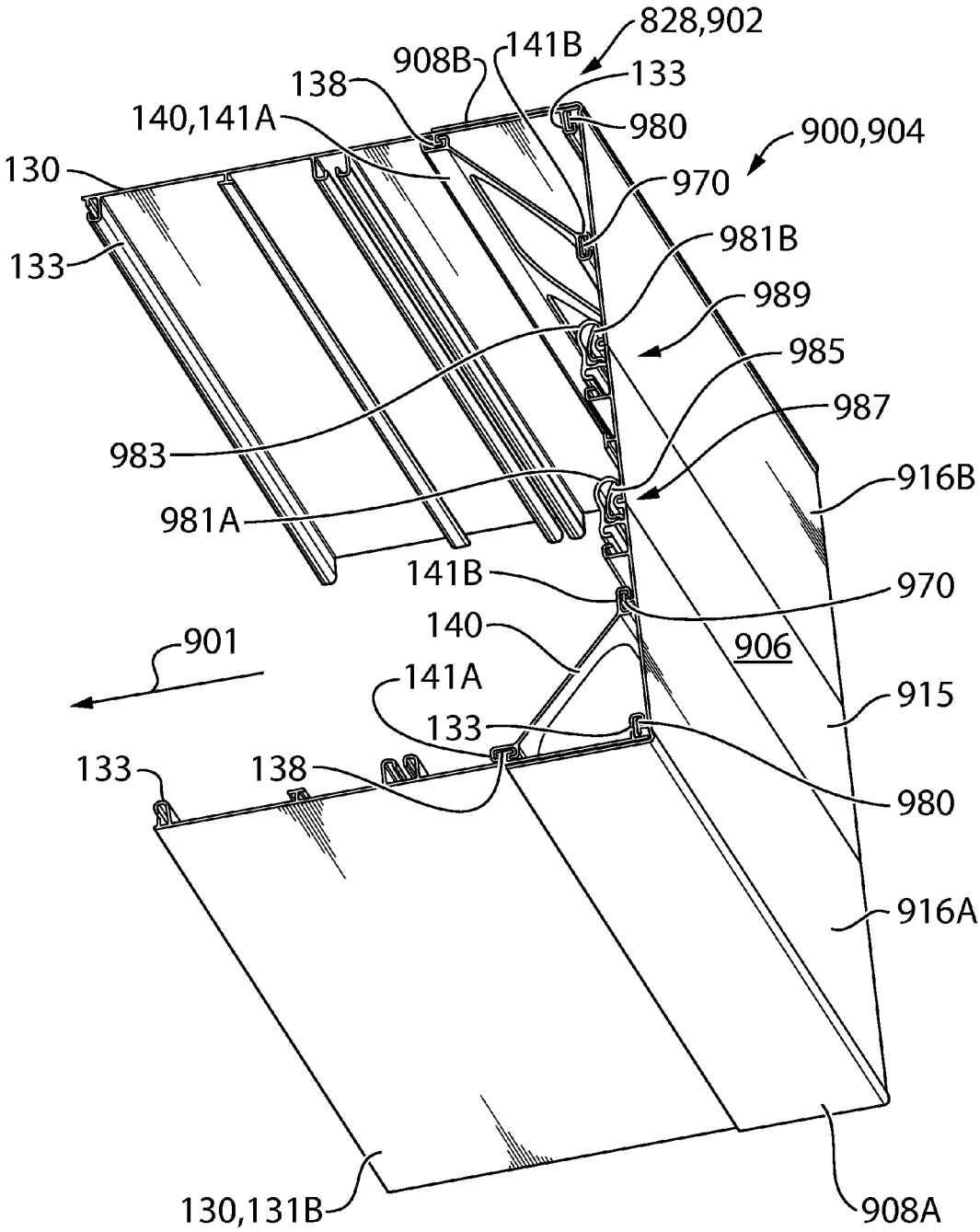
FIGS. 12A and 12B are respectively isometric and top plan views of a form edge system used to provide an edge of a modular stay-in-place form according to another example embodiment.
Figure 12B:
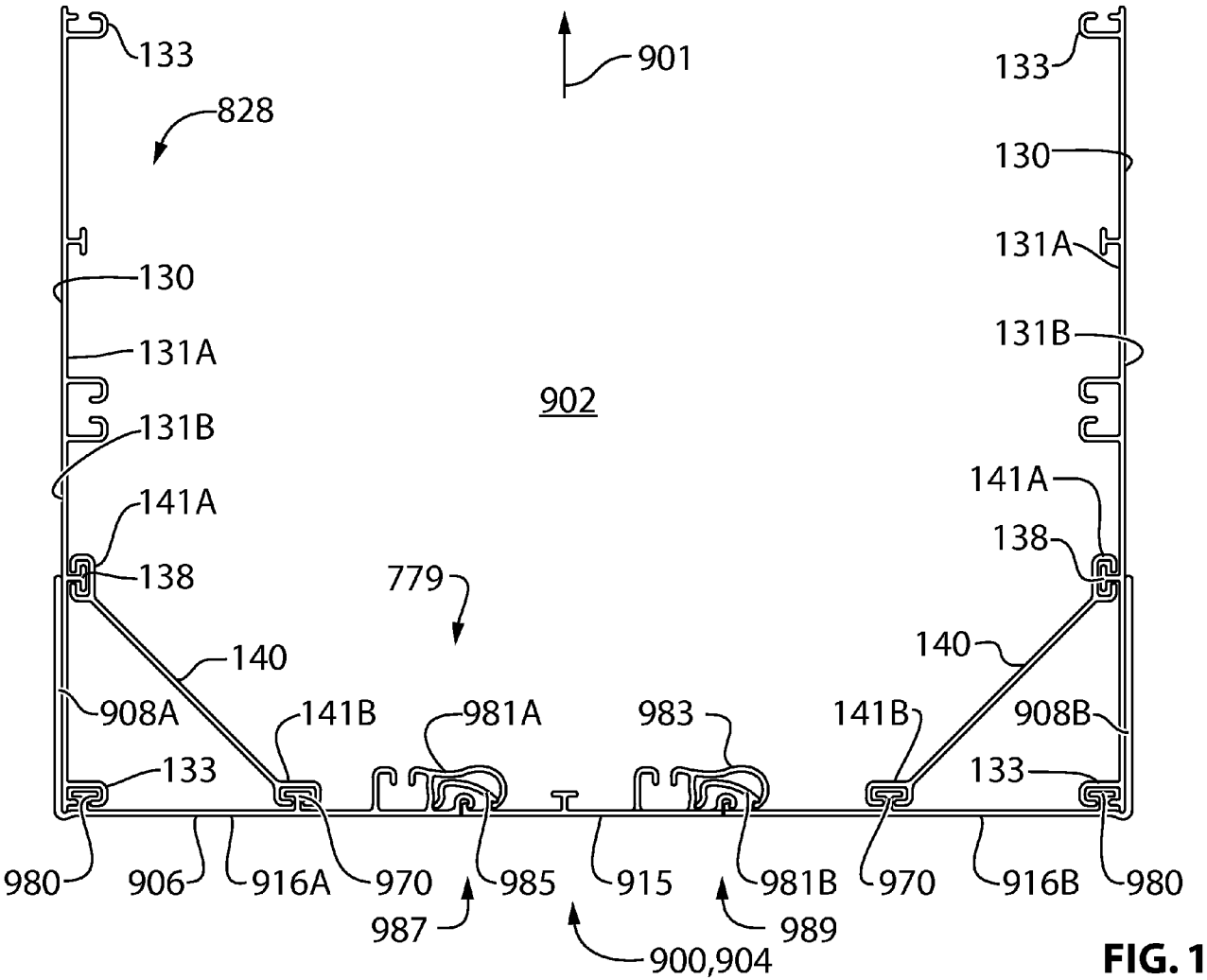

FIGS. 12A and 12B are respectively isometric and top plan views of a form edge system 900 according to another embodiment. Form edge system 900 may be a part of, and used to provide, an edge to form 828. Form edge system 900 may provide the part of form 828 used to fabricate the edge of a structure.

Form 828 of FIGS. 12A and 12B may be substantially similar to form 828 of FIGS. 11A and 11B. However, for clarity, support members 136 are not shown in FIGS. 12A and 12B Like FIGS. 11A and 11B, FIGS. 12A and 11B show only a single cell 902 on an edge of form 828 (i.e. an edge cell 902), it being appreciated that form 828 continues in direction 901 with additional panels 130 and support members 136 connected as described above.

Form edge system 900 comprises a multi-component frame member 904 similar in many respects to multi-component frame member 704 of form edge system 700 (FIGS. 11A, 11B). Similar reference numerals are used to refer to similar features of frame members 904, 704, except that features of frame member 904 are preceded by the leading digit "9" and features of frame member 704 are preceded by the leading digit "7". Frame member 904 comprises a pair of opposed L-shaped components 916A, 916B (collectively, L-shaped components 916) which are substantially similar to L-shaped components 716A, 716B and comprise: corresponding panel flanges 908A, 908B which extend away from the edges of panel 906 to abut against the outward surfaces 131B of panels 130; connector components 970 for connecting to complementary connector components 141B on optional tensioning members 140; and connector components 980 for connecting to complementary terminal connector components 133 on panels 130 of edge cell 702. L-shaped components 916A, 916B also respectively comprise connector components 981A, 981B which are substantially similar to connector components 781A, 781B of L-shaped connector components 716A, 716B.

Form edge system 900 and frame member 904 differ from form edge system 700 and frame member 704 in that frame member 904 includes a central component 915 which is connected between L-shaped components 916A, 916B. Central component 915 comprises a first connector component 985 which is complementary to connector component 981A of L-shaped component 916A and which is connected to connector component 981A of L-shaped component 916A to form connection 987. Central component 915 comprises a second connector component 983 which is complementary to connector component 981B of L-shaped component 916B and which is connected to connector component 981B of L-shaped component 916B to form connection 989. The inclusion of central component 915 may be used to alter the width of frame member 904 (e.g. in comparison to frame member 704). It will be appreciated that the modular nature of components 915, 916A, 916B and the complementary nature of connector components 981A, 981B, 983, 985 is such that any number of central components 915 could be inserted between L-shaped components 916A, 916B to achieve a desired width of frame member 904 and form edge system 900.

In other respects, form edge system 900 and frame member 904 are similar to form edge system 700 and frame member 704.

While a number of exemplary aspects and embodiments have been discussed above, those of skill in the art will recognize certain modifications, permutations, additions and sub-combinations thereof. For example:

The buck and form edge system embodiments described herein may be adapted for use with plastic form-works having an arrangement of components (e.g. panels, support members, tensioning members, etc.) different than those which are described herein. The buck and form edge embodiments described herein may also be used or adapted for use with other types of form-works, such as, for example, wood or wood composite forms, insulated concrete forms and metal forms.

In the illustrated embodiments, the arrangement of slidable connector components comprise C-shaped female connector components for slidably receiving complementary T-shaped male connector components. This is not necessary. In general, the arrangement of male and female slidable connector components may comprise any suitable complementary pairs of connector components. Also, the connector components need not slidably engage one another and may be coupled to one another by pivotal motion or by deformation of one or both connector components or by any other suitable coupling technique.

In the illustrated embodiments, each frame member 204 includes panel flanges 208A, 208B extending from opposed edges 207A, 207B of panel 206. However, panel flanges are not necessary. In some embodiments, frame members 204 are formed without panel flanges 208A, 208B, and may be assembled to form a buck which does not have frames 211A, 211B for abutting against outer surfaces 131B of panels 130A, 130B. If desired, panel flanges 208A, 208B of suitable dimensions may be provided as supplementary components which may later be connected in some suitable fashion to the buck or to the underlying concrete structure once it is formed.

A plurality of bucks according to the embodiments described herein may be positioned in cell 202 of form 128 to define a plurality of building openings 201. For example, a plurality of bucks 200 may be arranged at longitudinally spaced apart locations in cell 202 of form 128. One or more fastener-receiving frames 251 may extend around all of the arranged bucks 200. Alternately, each buck 200 may have a separate fastener-receiving frame 251 mounted thereto.

In some embodiments, locking member 238 may be adjustable to accommodate different miter joints between adjacent fastener-receivers 226, as may be necessary for connecting different polygonally-shaped bucks 200 (e.g. triangular, pentagonal, hexagonal, or octagonal-shaped bucks). For example, arm portions 242, 243 of locking member 238 may be pivotally connected at arm intersection portion 284 so that an interior angle between arm portions 242, 243 is adjustable.

In some embodiments, it may be desirable to provide walls which incorporate insulation. Insulation may be provided in the form of rigid foam insulation or other suitable forms of insulation. Non-limiting examples of suitable materials for rigid foam insulation include: expanded poly-styrene, poly-urethane, poly-isocyanurate or any other suitable moisture resistant material. Insulation layers may be provided in any of the forms described herein. Such insulation layers may extend in the vertical direction and in the transverse direction. Such insulation layers may be located centrally within the wall (e.g. between adjacent connector components 143) or at one side of the wall (e.g. between connector components 143 and one of form segments 124, 125). It will be appreciated that when fabricating walls using two-sided form 128, such insulation may be added before the liquid concrete is placed in the form.

In the embodiments described herein, the structural material used to fabricate the form segments is concrete. This is not necessary. In some applications, it may be desirable to use other structural materials (e.g. curable materials) which may initially be poured, sprayed or otherwise placed in the forms and may subsequently be cured to form structural building components.

In the embodiments described above, the various features of panels 130 (e.g. connector components 133), support members 136 (e.g. connector components 134, 143) and tensioning members 140 (e.g. connector components 141A, 141B) are substantially co-extensive with panels 130, support members 136 and tensioning members 140 in the vertical dimension. This is not necessary. In some embodiments, such features may be located at various locations on the vertical (in the illustrated views) dimension of panels 130, support members 136 and tensioning members 140 and may be absent at other locations on the vertical (in the illustrated views) dimension of panels 130, support members 136 and tensioning members 140. Forms incorporating any of the other panels described herein may comprise similarly dimensioned support members and/or tensioning members.

In some embodiments, sound-proofing materials may be layered into the form-works described above or may be connected to attachment units.

In some embodiments, the form-works described herein may be used to fabricate ceilings or floors of buildings or a variety of other structures. In general, the form-works described above are not limited to building structures and may be used to construct any suitable structures formed from concrete or similar materials. Non-limiting examples of such structures include transportation structures (e.g. bridge supports and freeway supports), beams, foundations, sidewalks, pipes, tanks, beams or the like.

Structures (e.g. walls) fabricated according to the invention may have curvature. Where it is desired to provide a structure with a certain radius of curvature, panels on the inside of the curve may be provided with a shorter length than corresponding panels on the outside of the curve. This length difference will accommodate for the differences in the radii of curvature between the inside and outside of the curve. It will be appreciated that this length difference will depend on the thickness of the structure.

In some embodiments, the frame members of the buck or the form edge systems may have curved panels and panel flanges for forming building openings having curved sides. For example, curved frame members may be arranged with other like curved frame members to form a round building opening.

In some embodiments, locking members are not required to connect adjacent fastener-receivers 226 to one another. Suitable fasteners (e.g. screws or the like extending through the miter joints) may be used to connect adjacent fastener-receivers 226.

Many embodiments and variations are described above. Those skilled in the art will appreciate that various aspects of any of the above-described embodiments may be incorporated into any of the other ones of the above-described embodiments by suitable modification.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck, the fastener-receiving frame comprising one or more fastener-retaining members for retaining fasteners which penetrate therethrough.

2. A buck according to claim 1 wherein the plurality of fastener-receivers are connectable to one another and, when connected to the first sides of the panels and to one another, the fastener-receivers thereby connect the plurality of frame members to one another.

3. A buck according to claim 2 wherein each fastener-receiver: extends along a longitudinal dimension of the first side of the panel of a corresponding frame member; comprises a pair of longitudinally opposed edge portions which abut against adjacent edge portions of a pair of adjacent fastener-receivers; and connects to the pair of adjacent fastener-receivers to thereby connect the corresponding frame member to a pair of adjacent frame members.

4. A buck according to claim 3 wherein each fastener-receiver comprises at least one longitudinally extending locking member-retaining channel.

5. A buck according to claim 4 comprising one or more locking members, each locking member comprising: a first arm portion for insertion into a first locking member-retaining channel of a first fastener-receiver; and a second arm portion for insertion into a second locking member-retaining channel of a second fastener-receiver, the second fastener-receiver adjacent the first fastener-receiver.

6. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck, the fastener-receiving frame comprising one or more fastener-retaining members for retaining fasteners which penetrate therethrough, wherein the plurality of fastener-receivers are connectable to one another and, when connected to the first sides of the panels and to one another, the fastener-receivers thereby connect the plurality of frame members to one another, wherein each fastener-receiver: extends along a longitudinal dimension of the first side of the panel of a corresponding frame member; comprises a pair of longitudinally opposed edge portions which abut against adjacent edge portions of a pair of adjacent fastener-receivers; and connects to the pair of adjacent fastener-receivers to thereby connect the corresponding frame member to a pair of adjacent frame members, wherein each fastener-receiver comprises at least one longitudinally extending locking member-retaining channel;

one or more locking members, each locking member comprising: a first arm portion for insertion into a first locking member-retaining channel of a first fastener-receiver; and a second arm portion for insertion into a second locking member-retaining channel of a second fastener-receiver, the second fastener-receiver adjacent the first fastener-receiver;

wherein each locking member comprises a plurality of notches defined along opposed edges of the first arm portion and a plurality of notches defined along opposed edges of the second arm portion.

7. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck, the fastener-receiving frame comprising one or more fastener-retaining members for retaining fasteners which penetrate therethrough, wherein the plurality of fastener-receivers are connectable to one another and, when connected to the first sides of the panels and to one another, the fastener-receivers thereby connect the plurality of frame members to one another, wherein each fastener-receiver: extends along a longitudinal dimension of the first side of the panel of a corresponding frame member; comprises a pair of longitudinally opposed edge portions which abut against adjacent edge portions of a pair of adjacent fastener-receivers; and connects to the pair of adjacent fastener-receivers to thereby connect the corresponding frame member to a pair of adjacent frame members, wherein each fastener-receiver comprises at least one longitudinally extending locking member-retaining channel;

one or more locking members, each locking member comprising: a first arm portion for insertion into a first locking member-retaining channel of a first fastener-receiver; and a second arm portion for insertion into a second locking member-retaining channel of a second fastener-receiver, the second fastener-receiver adjacent the first fastener-receiver;

wherein each locking member comprises one or more first apertures defined in the first arm portion for permitting one or more fasteners to extend therethrough and into the first fastener-receiver and one or more second apertures defined in the second arm portion for permitting one or more fasteners to extend therethrough and into the second fastener-receiver.

8. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck, the fastener-receiving frame comprising one or more fastener-retaining members for retaining fasteners which penetrate therethrough, wherein the plurality of fastener-receivers are connectable to one another and, when connected to the first sides of the panels and to one another, the fastener-receivers thereby connect the plurality of frame members to one another, wherein each fastener-receiver: extends along a longitudinal dimension of the first side of the panel of a corresponding frame member; comprises a pair of longitudinally opposed edge portions which abut against adjacent edge portions of a pair of adjacent fastener-receivers; and connects to the pair of adjacent fastener-receivers to thereby connect the corresponding frame member to a pair of adjacent frame members, wherein each fastener-receiver comprises at least one longitudinally extending locking member-retaining channel;

one or more locking members, each locking member comprising: a first arm portion for insertion into a first locking member-retaining channel of a first fastener-receiver; and a second arm portion for insertion into a second locking member-retaining channel of a second fastener-receiver, the second fastener-receiver adjacent the first fastener-receiver;

wherein each locking member comprises:

one or more first grippers which extend transversely away from the first arm portion for securing the first arm portion in the first locking member-retaining channel;

one or more second grippers which extend transversely away from the second arm portion for securing the second arm portion in the second locking member-retaining channel.

9. A buck according to claim 8 wherein:

the transverse extension of the one or more first grippers away from the first arm portion being relatively small in a distal region extending relatively large distance into the first locking member-retaining channel and being relatively large in a proximate region extending a relatively small distance into the first locking member-retaining channel; and the transverse extension of the one or more second grippers away from the second arm portion being relatively small in a distal region extending relatively large distance into the second locking member-retaining channel and being relatively large in a proximate region extending a relatively small distance into the second locking member-retaining channel.

10. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck, the fastener-receiving frame comprising one or more fastener-retaining members for retaining fasteners which penetrate therethrough, wherein the plurality of fastener-receivers are connectable to one another and, when connected to the first sides of the panels and to one another, the fastener-receivers thereby connect the plurality of frame members to one another, wherein each fastener-receiver: extends along a longitudinal dimension of the first side of the panel of a corresponding frame member; comprises a pair of longitudinally opposed edge portions which abut against adjacent edge portions of a pair of adjacent fastener-receivers; and connects to the pair of adjacent fastener-receivers to thereby connect the corresponding frame member to a pair of adjacent frame members, wherein each fastener-receiver comprises a longitudinally extending first mounting side oriented substantially parallel to the first side of the panel of the corresponding frame member, the first mounting side comprising a first set of one or more connector components complementary to one or more connector components on the first side of the panel of the corresponding frame member for connection of the fastener-receiver to the frame member and wherein the first set of connector components on the first mounting side of each fastener-receiver and the complementary connector components on the first side of the panel of each frame member comprise one or more of: male connector components which are slidably receivable in corresponding female connector components; and male connector components which are receivable in corresponding female connector components after deformation of one or both of the male and female connector components and which are lockable in a connected configuration by restorative deformation forces.

11. A buck according to claim 10 wherein each fastener-receiver comprises a longitudinally extending second mounting side opposing the first mounting side, the second mounting side comprising a second set of one or more connector components complementary to one or more connector components on the first mounting sides of other fastener-receivers for stackably coupling two or more fastener-receivers together.

12. A buck according to claim 1 wherein the first side of the panel of each frame member has two or more transversely spaced apart sets of connector components for connection thereto of two or more transversely spaced apart fastener-receivers, for forming two or more parallel fastener-receiving frames extending at least partially about a perimeter of the buck.

13. A buck according to claim 1 wherein the form-work is a stay-in-place form-work, wherein the first side of the panel of the one or more of the frame members comprises a set of one or more form-work-connecting connector components for connection to one or more complementary connector components on outer panels of the stay-in-place form-work and wherein the set of form-work-connecting connector components and the complementary connector components on the outer panels comprise one or more of: male connector components which are slidably receivable in corresponding female connector components; and male connector components which are receivable in corresponding female connector components after deformation of one or both of the male and female connector components and which are lockable in a connected configuration by restorative deformation forces.

14. A buck according to claim 13 wherein the one or more frame members comprises a pair of opposed side frame members and, for each side frame member, the set of form-work-connecting connector components comprises form-work-connecting connector components located proximate each of the longitudinally extending edges of the first side of the panel of the side frame member for connection with the complementary connector components on the outer panels at vertically extending edges of the outer panels of the stay-in-place form-work, the vertically extending edge proximate to the opening.

15. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck, the fastener-receiving frame comprising one or more fastener-retaining members for retaining fasteners which penetrate therethrough, wherein the first side of the panel of the one or more of the frame members comprises a set of one or more form-work-connecting connector components for connection to one or more complementary connector components on outer panels of the stay-in-place form-work and wherein the set of form-work-connecting connector components and the complementary connector components on the outer panels comprise one or more of: male connector components which are slidably receivable in corresponding female connector components; and male connector components which are receivable in corresponding female connector components after deformation of one or both of the male and female connector components and which are lockable in a connected configuration by restorative deformation forces, wherein the first side of the panel of the one or more frame members comprises a set of one or more tensioning-member-connecting connector components for connection to one or more complementary connector components on tensioning members extending angularly between the outer panels of the stay-in-place form-work and the one or more frame members and wherein the set of tensioning-member-connecting connector components and the complementary connector components on the tensioning members comprise one or more of: male connector components which are slidably receivable in corresponding female connector components; and male connector components which are receivable in corresponding female connector components after deformation of one or both of the male and female connector components and which are lockable in a connected configuration by restorative deformation forces.

16. A buck according to claim 15 wherein the one or more frame members comprises a pair of opposed side frame members and, for each side frame member, the set of tensioning-member-connecting connector components is spaced apart transversely from the set of form-work-connecting connector components for connection with the complementary connector components on tensioning members at vertically extending edges of the tensioning members of the stay-in-place form-work.

17. A buck according to claim 1 wherein each frame member comprises opposed first and second panel flanges extending from the opposed first and second longitudinal edges of the panel, oriented to extend away from the panel on outer sides of the outer opposed surfaces of the structure and shaped to contact the outer opposed surfaces of the structure.

18. A buck according to claim 17 wherein each frame member comprises a plurality of components connected to one another, the plurality of components comprising: a first edge component having a L-shape in cross section to provide the first panel flange and a first portion of the panel comprising the first longitudinal edge of the panel; and a second edge component having a L-shape in cross-section to provide the second panel flange and a second portion of the panel comprising the second longitudinal edge of the panel.

19. A buck according to claim 18 wherein the first edge component and the second edge component are connected to one another.

20. A buck according to claim 19 wherein the first edge component and the second edge component are connected to one another by one or more of the plurality of fastener-receivers.

21. A buck according to claim 18 wherein the plurality of connected components comprises one or more central components connected between the first and second edge components, each central component providing a corresponding central portion of the panel.

22. A buck according to claim 21 wherein the first edge component is connected to an adjacent one of the one or more central components by one or more of the plurality of fastener-receivers.

23. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck, the fastener-receiving frame comprising one or more fastener-retaining members for retaining fasteners which penetrate therethrough, wherein each frame member comprises opposed first and second panel flanges extending from the opposed first and second longitudinal edges of the panel, oriented to extend away from the panel on outer sides of the outer opposed surfaces of the structure and shaped to contact the outer opposed surfaces of the structure, wherein each of the opposed first and second panel flanges comprises at least one longitudinally extending locking member-receiving panel flange channel.

24. A buck according to claim 23 wherein each of the opposed first and second panel flanges comprises a pair of opposed longitudinally extending locking flanges extending transversely from its inward surface and toward one another to define the locking member-retaining panel flange channel.

25. A buck according to claim 24 comprising one or more locking members, each locking member comprising: a first arm portion for insertion into a first locking member-retaining panel flange channel of a first panel flange of a first frame member; and a second arm portion for insertion into a second locking member-retaining panel flange channel of a first panel flange of a second frame member, the second frame member edge adjacent to the first frame member.

26. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck wherein each fastener-receiver comprises at least one longitudinally extending locking member-receiving channel; and one or more locking members, each locking member comprising: a first arm portion for insertion into a first locking member-retaining channel of a first fastener-receiver; and a second arm portion for insertion into a second locking member-retaining channel of a second fastener-receiver, the second fastener-receiver adjacent the first fastener-receiver.

27. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck wherein each fastener-receiver comprises at least one longitudinally extending locking member-receiving channel; and one or more locking members, each locking member comprising: a first arm portion for insertion into a first locking member-retaining channel of a first fastener-receiver; and a second arm portion for insertion into a second locking member-retaining channel of a second fastener-receiver, the second fastener-receiver adjacent the first fastener-receiver, wherein each locking member comprises a plurality of notches defined along opposed edges of the first arm portion and a plurality of notches defined along opposed edges of the second arm portion.

28. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck wherein each fastener-receiver comprises at least one longitudinally extending locking member-receiving channel; and one or more locking members, each locking member comprising: a first arm portion for insertion into a first locking member-retaining channel of a first fastener-receiver; and a second arm portion for insertion into a second locking member-retaining channel of a second fastener-receiver, the second fastener-receiver adjacent the first fastener-receiver, wherein each locking member comprises one or more first apertures defined in the first arm portion for permitting one or more fasteners to extend therethrough and into the first fastener-receiver and one or more second apertures defined in the second arm portion for permitting one or more fasteners to extend therethrough and into the second fastener-receiver.

29. A stay-in-place buck for placement in a form-work to define an opening in a cast structure of concrete or similar curable construction material, the buck comprising:

a plurality of frame members arrangeable in an edge abutting relationship to define the opening, each frame member comprising a panel shaped to extend transversely between outer opposed surfaces of the structure, the panel having opposed first and second sides respectively facing away from and toward the opening, opposed first and second longitudinal edges, and a transverse dimension between the first and second longitudinal edges which is substantially equal to a transverse distance between the outer opposed surfaces of the structure; and a plurality of fastener-receivers connectable to the first sides of the panels to form at least one fastener-receiving frame extending at least partially about a perimeter of the buck wherein each fastener-receiver comprises at least one longitudinally extending locking member-receiving channel; and one or more locking members, each locking member comprising: a first arm portion for insertion into a first locking member-retaining channel of a first fastener-receiver; and a second arm portion for insertion into a second locking member-retaining channel of a second fastener-receiver, the second fastener-receiver adjacent the first fastener-receiver, wherein each locking member comprises:

one or more first grippers which extend transversely away from the first arm portion for securing the first arm portion in the first locking member-retaining channel;

one or more second grippers which extend transversely away from the second arm portion for securing the second arm portion in the second locking member-retaining channel.

30. A buck according to claim 29 wherein:

the transverse extension of the one or more first grippers away from the first arm portion being relatively small in a distal region extending relatively large distance into the first locking member-retaining channel and being relatively large in a proximate region extending a relatively small distance into the first locking member-retaining channel; and the transverse extension of the one or more second grippers away from the second arm portion being relatively small in a distal region extending relatively large distance into the second locking member-retaining channel and being relatively large in a proximate region extending a relatively small distance into the second locking member-retaining channel.

31. A buck according to claim 8 wherein each fastener-receiver comprises:

opposed longitudinally extending locking sides oriented substantially perpendicularly to the first side of the panel of the corresponding frame member; and a pair of opposed longitudinally extending locking flanges extending transversely from each locking side and toward one another to define the locking member-retaining channel.

32. A buck according to claim 9 wherein each fastener-receiver comprises:

opposed longitudinally extending locking sides oriented substantially perpendicularly to the first side of the panel of the corresponding frame member; and a pair of opposed longitudinally extending locking flanges extending transversely from each locking side and toward one another to define the locking member-retaining channel.

33. A buck according to claim 3 wherein each fastener-receiver comprises a longitudinally extending first mounting side oriented substantially parallel to the first side of the panel of the corresponding frame member, the first mounting side comprising a first set of one or more connector components complementary to one or more connector components on the first side of the panel of the corresponding frame member for connection of the fastener-receiver to the frame member and wherein the first set of connector components on the first mounting side of each fastener-receiver.

* * * * *